US008984665B2

(12) United States Patent
Celona et al.

(10) Patent No.: US 8,984,665 B2
(45) Date of Patent: Mar. 24, 2015

(54) HELMET MOUNTING SYSTEM AND MOUNTING SHOE INTERFACE

(75) Inventors: Marc J. Celona, Dover, NH (US); Dominic R. Goupil, Kittery, ME (US); Gary M. Lemire, Lee, NH (US); James W. Teetzel, York, ME (US); Justin D. Harris, Haverhill, MA (US)

(73) Assignee: Wilcox Industries Corp., Newington, NH (US)

( * ) Notice: Subject to any disclaimer, the term of this patent is extended or adjusted under 35 U.S.C. 154(b) by 866 days.

(21) Appl. No.: 13/019,889

(22) Filed: Feb. 2, 2011

(65) Prior Publication Data

US 2011/0239354 A1 Oct. 6, 2011

Related U.S. Application Data

(60) Provisional application No. 61/300,770, filed on Feb. 2, 2010, provisional application No. 61/351,084, filed on Jun. 3, 2010.

(51) Int. Cl.
*A42B 3/00* (2006.01)
*A42B 3/04* (2006.01)

(52) U.S. Cl.
CPC ..... *A42B 3/04* (2013.01)
USPC ..... 2/6.2; 2/422

(58) Field of Classification Search
USPC ..... 2/6.2, 6.6, 422, 6.1–6.5, 425, 451; 359/409
See application file for complete search history.

(56) References Cited

U.S. PATENT DOCUMENTS 4,156,292 A 5/1979 Helm et al.
4,242,757 A 1/1981 Nava
(Continued)

FOREIGN PATENT DOCUMENTS

FR 2677604 A1 12/1992
GB 2470831 A 12/2010
WO WO 2006065805 A2 * 6/2006

OTHER PUBLICATIONS

U.S. Appl. No. 12/117,704, filed May 8, 2008.
(Continued)

*Primary Examiner* — Shaun R Hurley
*Assistant Examiner* — Andrew W Sutton
(74) *Attorney, Agent, or Firm* — McLane, Graf, Raulerson & Middleton, Professional Association

(57) ABSTRACT

An improved helmet mounting device for an optical or other viewing device is provided. The helmet mount includes a mounting assembly removably attachable to the helmet and a pivoting assembly having a first end pivotally attached to the mounting assembly and a second end opposite the first end. A fore and aft adjustment assembly is attached to the second end of the pivoting assembly and a left and right adjustment assembly is rotatably attached to the fore and aft adjustment assembly. The left and right adjustment assembly is pivotal relative to the fore and aft adjustment assembly about a first generally vertical axis. An optical device mounting member is attached to the left and right adjustment assembly and the optical device mounting member is removably attachable to the optical device. The mounting assembly includes a vertical adjust mechanism which has a base plate, a pair of guide rails attached to the base plate and defining a channel therebetween, a sliding plate slidably attached to the guide rails, and a clamping mechanism for selectively applying a clamping force to secure the sliding plate at a desired position relative to said base plate. In further aspects, modular electrical connectors and a remote battery box for providing power to the optical device or other viewing device are provided.

22 Claims, 20 Drawing Sheets

(56) References Cited

U.S. PATENT DOCUMENTS

| | | | | |
|---|---|---|---|---|
| 4,449,787 | A | 5/1984 | Burbo et al. | |
| 4,577,347 | A | 3/1986 | Connon | |
| 4,660,943 | A | 4/1987 | Ellis | |
| 4,689,834 | A | 9/1987 | McCarthy et al. | |
| 4,901,210 | A | 2/1990 | Hanabusa | |
| 4,987,608 | A | 1/1991 | Cobb | |
| 5,265,276 | A | 11/1993 | Kimberly, Jr. | |
| 5,367,402 | A | 11/1994 | Holmes et al. | |
| 5,408,086 | A | 4/1995 | Morris et al. | |
| 5,412,811 | A | 5/1995 | Hildenbrand et al. | |
| 5,416,922 | A | 5/1995 | Horvat et al. | |
| 5,467,479 | A | 11/1995 | Mattes | |
| 5,471,678 | A | 12/1995 | Dor | |
| 5,506,730 | A | 4/1996 | Morley et al. | |
| 5,535,053 | A | 7/1996 | Baril et al. | |
| 5,542,627 | A | 8/1996 | Crenshaw et al. | |
| 5,581,806 | A | 12/1996 | Capdepuy et al. | |
| 5,703,354 | A | 12/1997 | Wannagot et al. | |
| D392,071 | S | 3/1998 | Berke | |
| D402,421 | S | 12/1998 | Berke | |
| 5,898,472 | A | 4/1999 | Oshikawa | |
| 5,914,816 | A | 6/1999 | Soto et al. | |
| 5,920,371 | A | 7/1999 | Chang et al. | |
| 6,457,179 | B1 | 10/2002 | Prendergast | |
| 6,462,867 | B2 | 10/2002 | Choinere | |
| 6,472,776 | B1 | 10/2002 | Soto et al. | |
| 6,560,029 | B1 | 5/2003 | Dobbie et al. | |
| 6,662,370 | B1 | 12/2003 | Buchanan, Jr. | |
| 6,795,977 | B2 | 9/2004 | Basson et al. | |
| 6,957,449 | B2 | 10/2005 | Prendergast | |
| 7,219,370 | B1 * | 5/2007 | Teetzel et al. | 2/6.2 |
| 7,735,159 | B2 | 6/2010 | Prendergast | |
| 8,209,780 | B1 * | 7/2012 | Lemire | 2/422 |
| 2002/0120979 | A1 | 9/2002 | Prendergast | |
| 2005/0111097 | A1 * | 5/2005 | Iannarelli et al. | 359/409 |
| 2007/0214551 | A1 * | 9/2007 | Teetzel et al. | 2/422 |
| 2008/0170838 | A1 * | 7/2008 | Teetzel et al. | 386/118 |
| 2008/0263752 | A1 * | 10/2008 | Solinsky et al. | 2/422 |
| 2010/0299814 | A1 * | 12/2010 | Celona et al. | 2/422 |
| 2011/0145981 | A1 * | 6/2011 | Teetzel et al. | 2/422 |
| 2011/0239354 | A1 * | 10/2011 | Celona et al. | 2/422 |
| 2013/0083391 | A1 * | 4/2013 | Teetzel et al. | 359/409 |

OTHER PUBLICATIONS

U.S. Appl. No. 12/259,010, filed Oct. 27, 2010.
U.S. Appl. No. 12/759,435, filed Apr. 13, 2010.
U.S. Appl. No. 12/951,969, filed Nov. 22, 2010.

* cited by examiner

HELMET MOUNTING SYSTEM AND MOUNTING SHOE INTERFACE

CROSS-REFERENCE TO RELATED APPLICATIONS

This application claims the benefit of priority under 35 U.S.C. §119(e) based on U.S. provisional application No. 61/300,770 filed Feb. 2, 2010, and U.S. provisional application No. 61/351,084 filed Jun. 3, 2010, each of which is incorporated herein by reference in its entirety.

SUMMARY

In a first aspect, the present disclosure relates to a helmet mounting system and method for integrating a viewing device with a field helmet and for remotely supplying power to an attached optical device from a power supply remotely located on the helmet. In a second aspect, a mounting shoe interface is provided which allows power, ground and/or signal to pass from one device to another through the interface. The mounting shoe interface herein finds utility with the helmet mounting system as shown and described herein, however, it will be recognized that the mounting system is equally applicable to any type of mounting system which can be used to provide power or a data signal to and from multiple items, wherein the items can readily be connected, disconnected and interchanged.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 2 is a front elevational view of the embodiment shown in

FIG. 1.

DETAILED DESCRIPTION OF THE PREFERRED EMBODIMENTS

Figure 1:
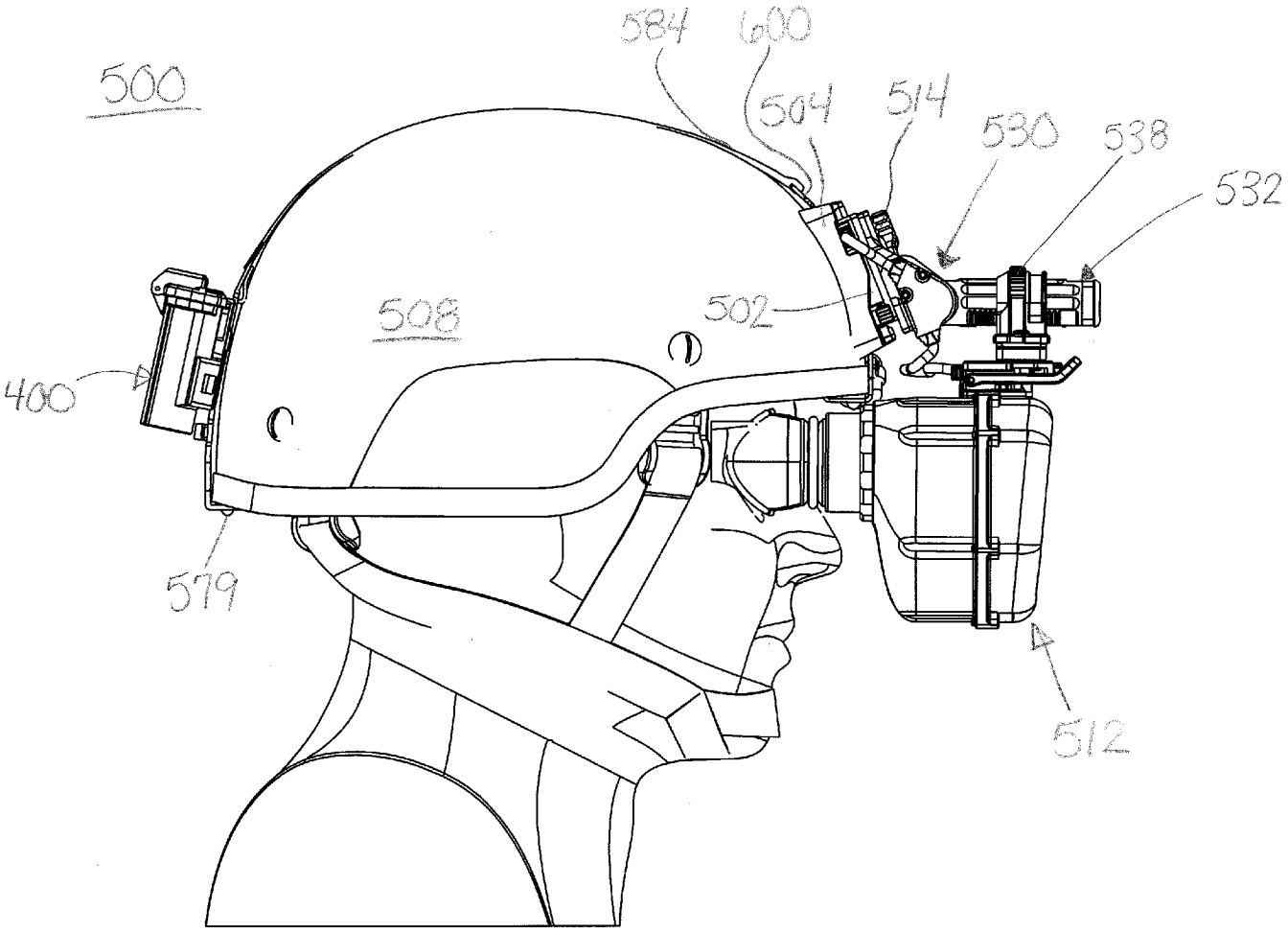
FIG. 1 is a side elevational view of a helmet carrying a helmet mount according to an exemplary embodiment of the present invention, wherein the helmet mount supports viewing optics in an operational or viewing position.
Figure 2:
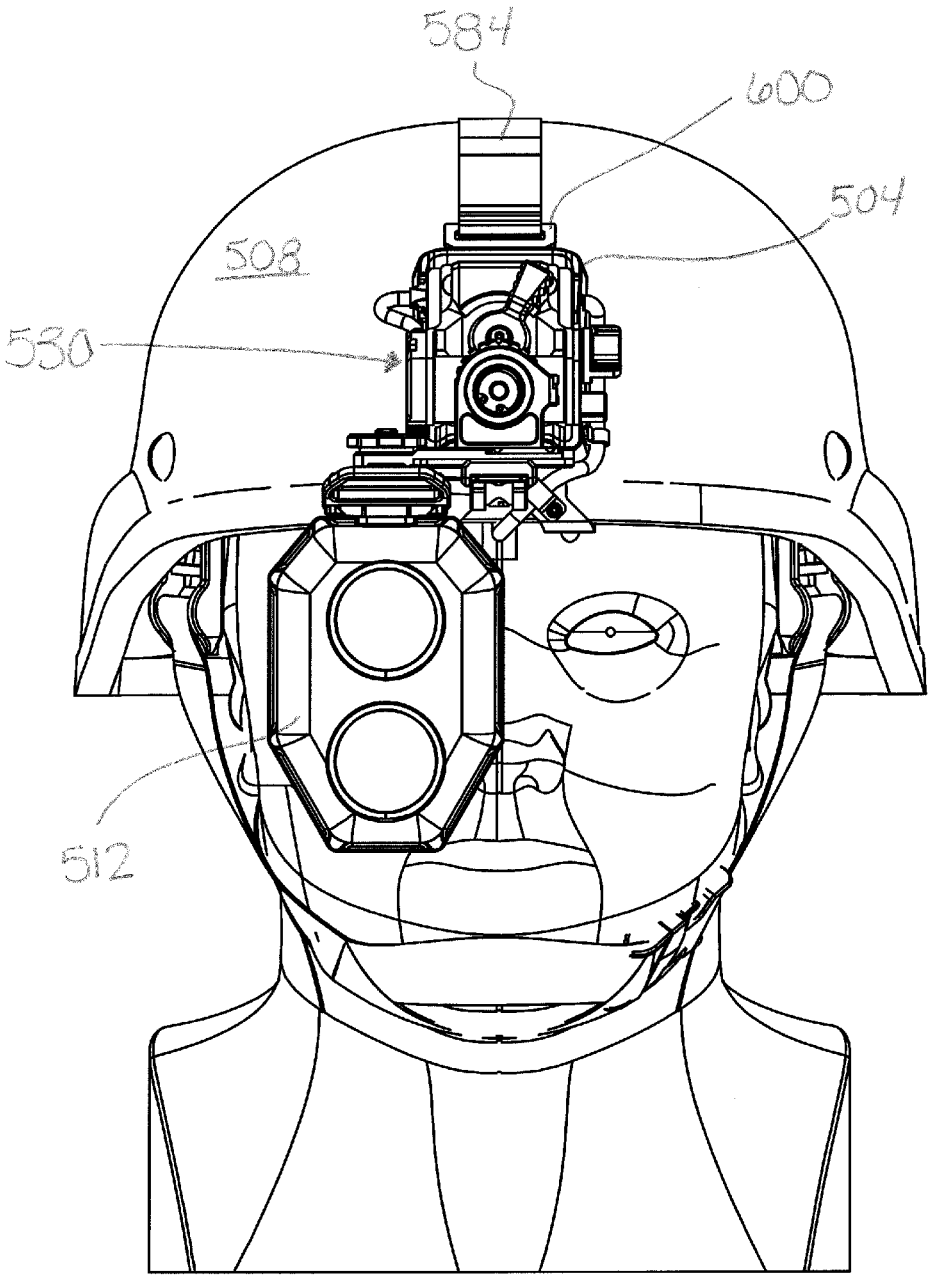
Figure 3:
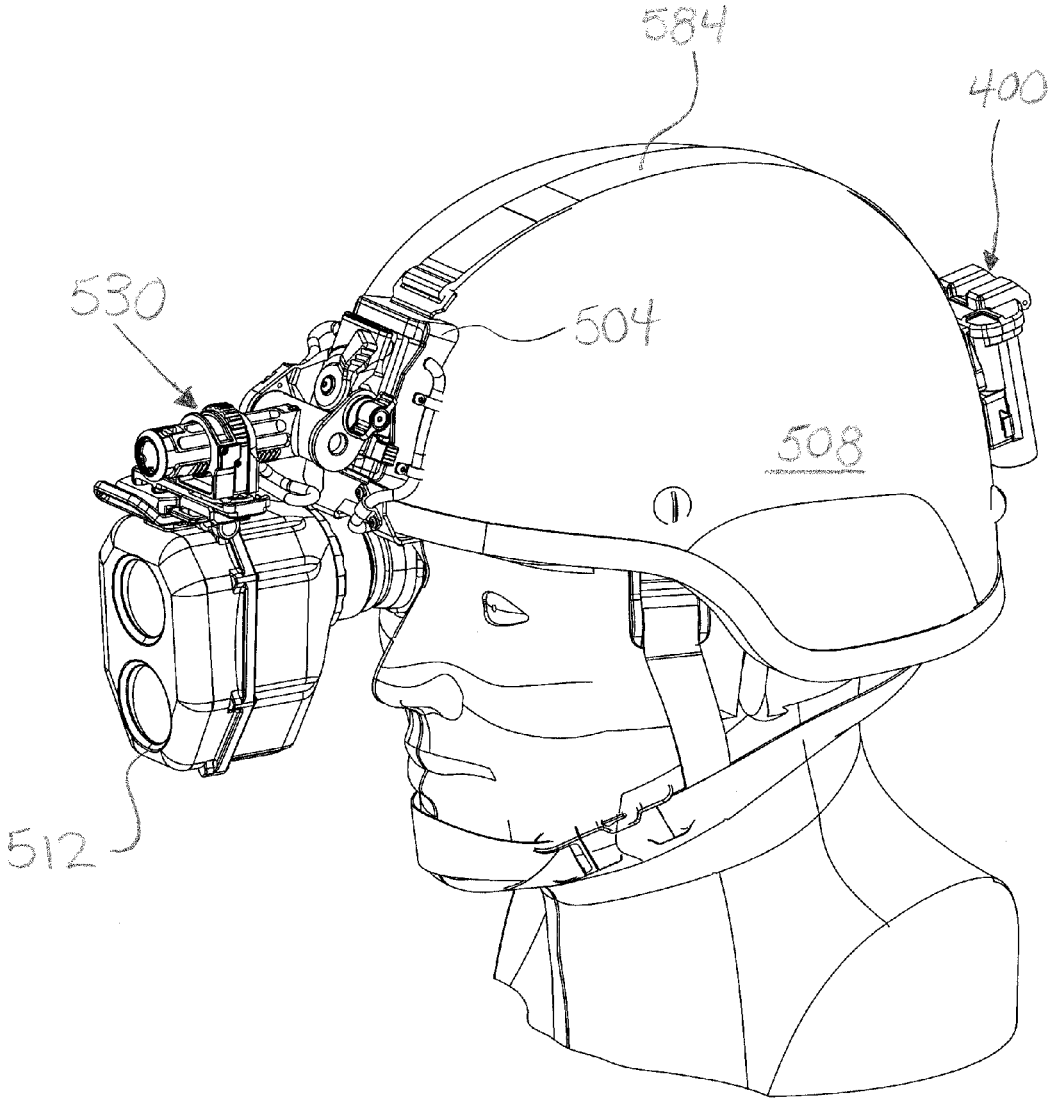
FIG. 3 is an isometric view of the embodiment shown in FIGS. 1 and 2, taken generally from the front and left side (from the perspective of the wearer).
Figure 4:
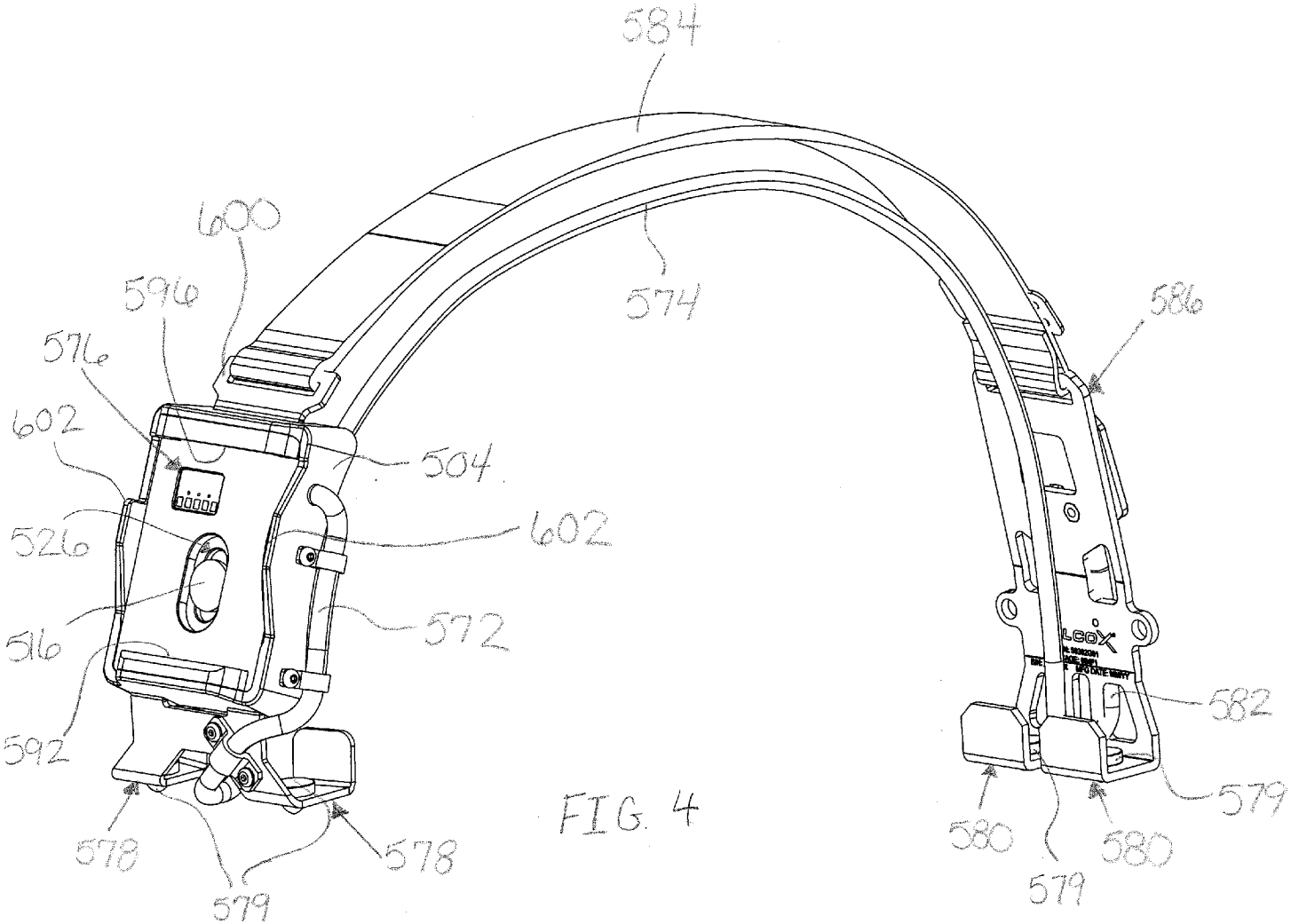
FIG. 4 is an isometric view of the helmet mount strap appearing in FIG. 1, with the viewing optics, helmet mount, and power supply removed.
Figure 5:
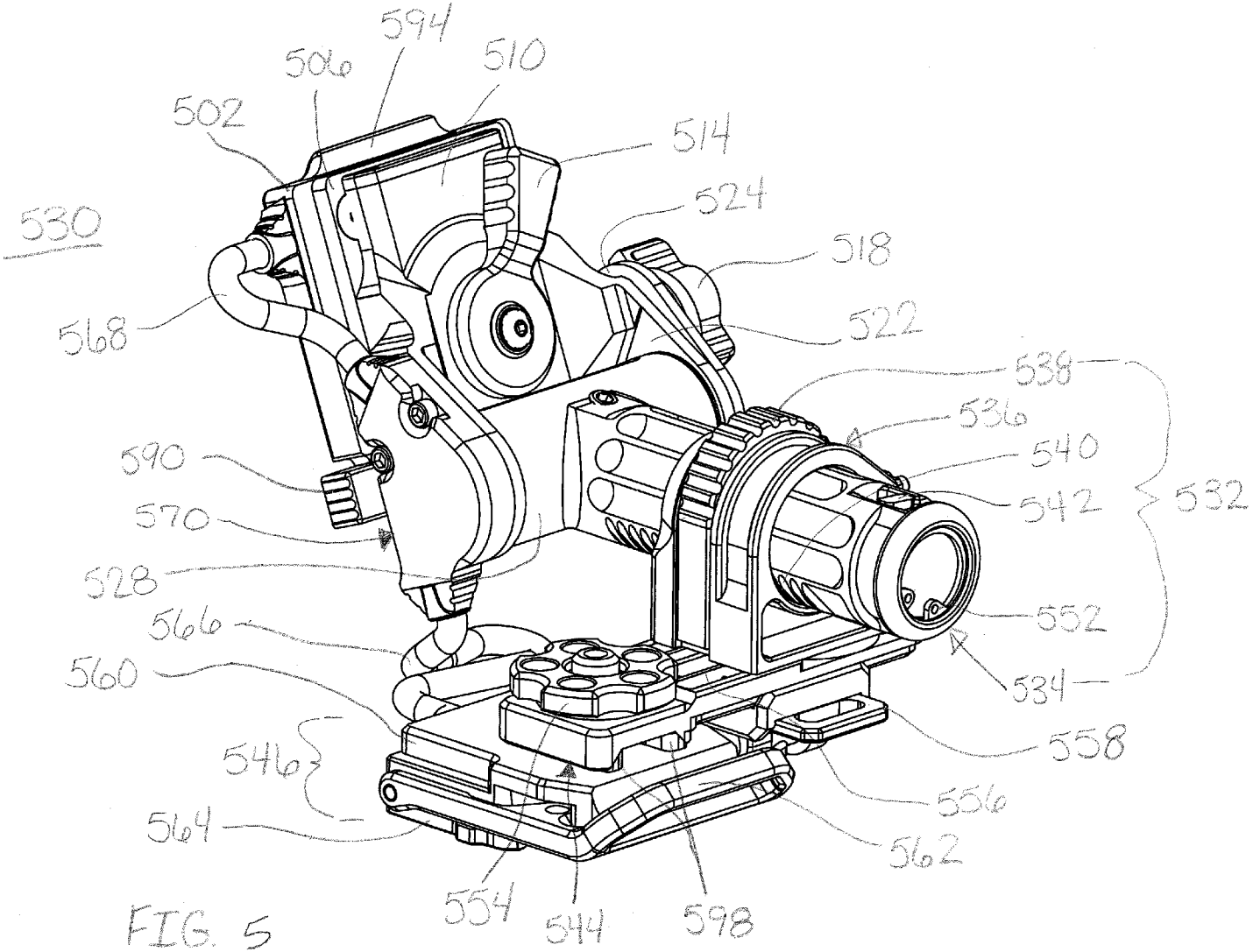
FIG. 5 is an enlarged perspective view illustrating the helmet mount mechanism and mounting plate, taken generally from the front and the wearer's right side, with the viewing optics removed.
Figure 6:
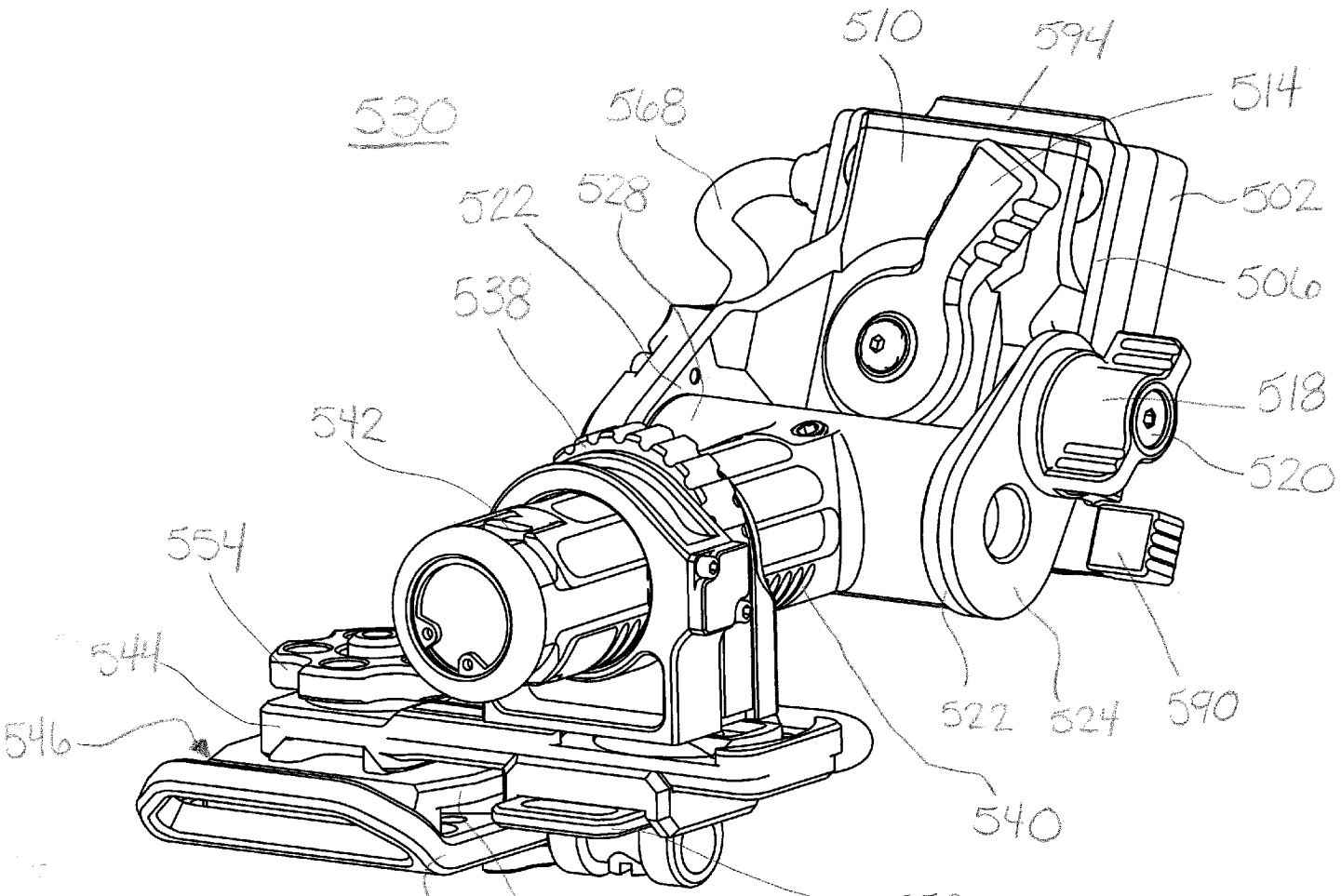
FIG. 6 is an enlarged perspective view illustrating the helmet mount mechanism and mounting plate, taken generally from the front and the wearer's left side, with the viewing optics removed.
Figure 7:
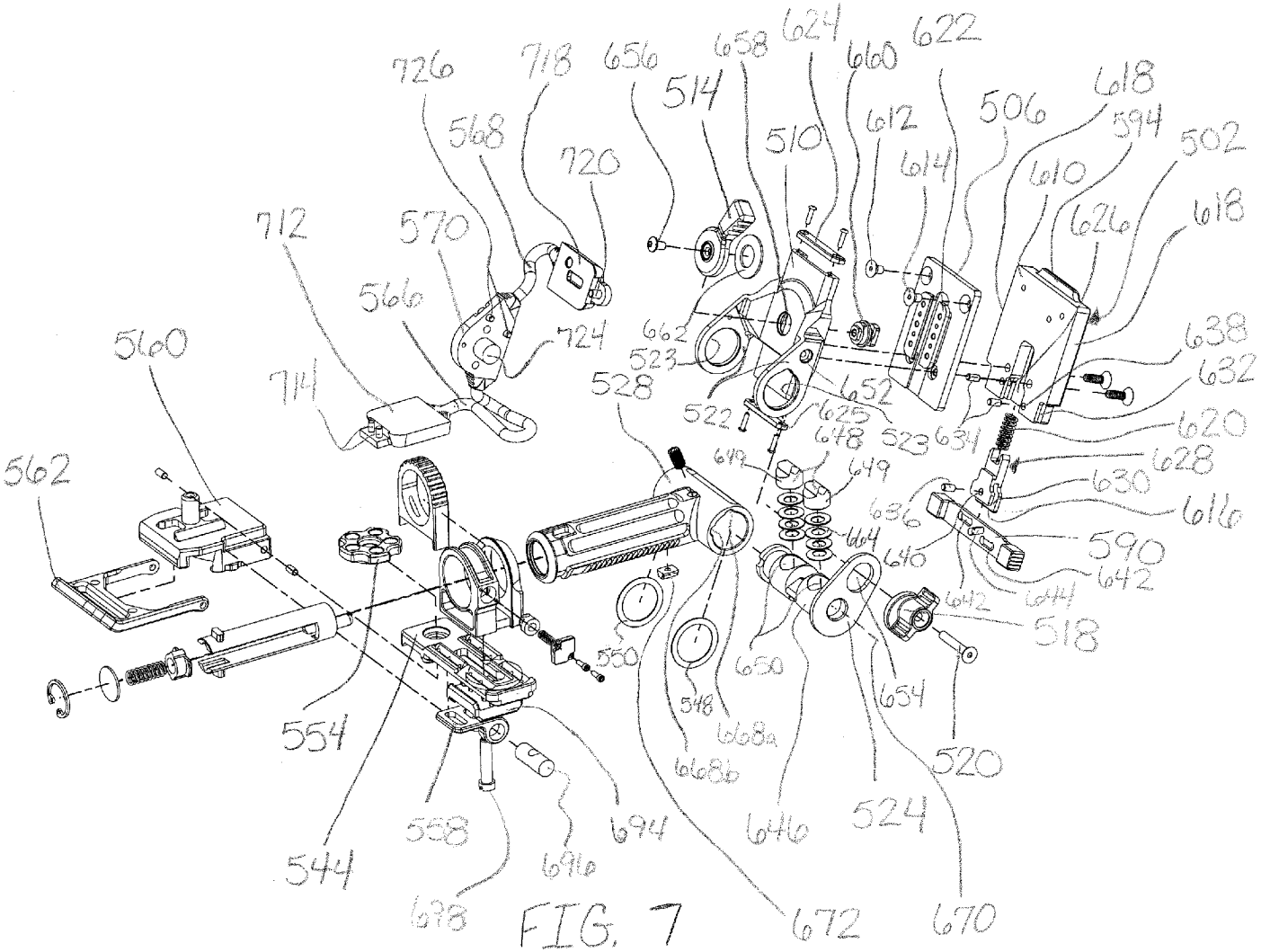
FIG. 7 is an exploded view illustrating the helmet mounting assembly shown in FIGS. 5 and 6.

Referring now to FIGS. 1-13, and with particular reference to FIGS. 1-3, there appears an exemplary helmet mounting system embodiment 500 of the present invention. The helmet mounting system 500 includes a connection bracket assembly 504 attached to the front portion of a helmet 508. A helmet mount assembly 530 is removably attached at a first end to the connection bracket 504 and includes a second end adapted to be removably attached to an optical device 512. The optical device 512 may be monocular or binocular night vision goggle, binoculars, helmet mounted display screen, head-up display or any other helmet mounted optical, electro-optical or other viewing device.

The connection bracket 504 couples to the helmet 508 utilizing a mechanical fastener 516 such as a threaded fastener or the like. Also, a pair of laterally spaced-apart front hook members 578 may be used to engage the brim of the helmet 508, thereby providing three points of attachment of the connection bracket 504. The hook members 578 may include noise and/or vibration dampening members 579 formed of a flexible, elastic, or resilient material. The dampening members 579 may be pads, grommets engaging holes formed in the hooks 578, or the like. In addition, a strap 584 which is attached to a bracket 600 on the top of connection bracket 504 runs over the top of the helmet 508 and provides an additional point of attachment of the connection bracket 504. Commonly, military helmets are provided with a single hole predrilled in the front thereof and the embodiment 500 is advantageous in that it may readily be adapted to employ such a predrilled hole for receiving the fastener 516.

Referring now to FIGS. 4-8, and with continued reference to FIGS. 1-3, there appears a helmet mount assembly 530 which contains a pivoting assembly for moving between an operational position and a stowed position, wherein the pivoting assembly is similar to the pivoting assembly of the helmet mounting system described in U.S. patent application Ser. No. 12/951,969 filed on Nov. 22, 2010. The aforementioned application is incorporated herein by reference in its entirety. The helmet mount assembly 530 includes a rear plate 502 that interfaces with the connection bracket 504. The connection bracket 504 contains guide rails 602, a first opening, e.g., defined by lower groove lip 592, and a second opening, e.g., defined by upper groove lip 596. The rear plate 502 embodiment shown in FIG. 15 includes a base member 610 and has a vertical adjust plate assembly 506 secured thereto, e.g., via fasteners 612 and 614. The base member 610 includes a locking tongue 616 slidably carried thereon and side walls 618. The side walls 618 mate with the guide rails 602 formed on bracket 504. The locking tongue 616 engages the lower groove lip 592 of the bracket 504. A tension member 620 such as a spring may be provided to prevent movement or rattling between the rear plate 502 and the connection bracket 504 and to bias the locking tongue 616 into engagement with the lower groove lip 592.

The helmet mount assembly 530 includes a sliding plate 510 which slides vertically with respect to the vertical adjust plate assembly 506. The sliding plate 510 is slidably received over locking rails 622 disposed on the plate 506. A first cover plate 624 is secured to the upper open end of the sliding plate 510 and a second cover plate 625 is secured to the lower open end of the sliding plate 510. The cover plates 624, 625 act as stops to limit the extent of sliding movement of the sliding plate 510 and to prevent the sliding plate 510 from disengaging the rails 622. Covering the ends also helps to prevent debris from entering the space between the sliding plate 510 and the vertical adjustment plate 506, which may interfere with the sliding movement of the plates 510 and 506 of the helmet mount assembly 530. The sliding plate 510 is selectively positionable relative to the plate 506 to provide a vertical adjustment of the optical device relative to the eyes of the wearer and is described in greater detail below.

The rear plate 502 secures the helmet mount assembly 530 to the helmet 508 via the connection bracket 504. The rear plate 502 includes the interface base member 610 with a first channel 626. The first channel 626 receives a tension member 620, such as a captured spring, which is secured in the channel 626 by a locking tongue member 628. A first end of the locking tongue member 628 engages the tension member 620 and a second end includes a transverse groove or recess 630 and the locking tongue 616. An actuator bar 590 slides into recesses 632 of the interface base 610 and the recess 630 of the locking tongue member 628, thereby securing the tongue member 628 into the channel 626 in cooperation with pins 634 and 636 engaging aligned openings 638 and 640 in the base member 610 and locking tongue 628, respectively. The actuator bar 590 has two elongated openings 642, each engaging one of the pins 634, and an elongated opening 644 engaging the pin 636. The elongated openings 642 and 644 allow transverse sliding movement of the actuator 590 and cooperates with the tension of member 620 to enable the locking tongue member 628 to be moved from an open position to a locked or engaged position wherein the locking tongue 616 protrudes out from the rear plate 502 to engage the lower groove lip 592. The elongate openings 642 extend transversely and the pins 634 constrain the sliding movement of the actuator 590 to transverse movement. The opening 644 extends at an angle relative to the transverse openings 642. As the pin 636 runs in the angled opening 644, the tongue member 628 is selectively advanced and retracted. The ends of the elongate openings 642 may be slightly enlarged such that the spring tension will assist in retaining the actuator 590 in the selected one of the locked and unlocked positions.

When the locking tongue 616 is moved into its engaged position, the rear plate 502 can be secured to the connection bracket 504. To secure the rear plate 502 to the connection bracket 504, a user would slide the actuator bar 590, e.g., to the user's right to cause the pin 636 to ride to the upper end of the angled slot 644, thereby retracting the locking tongue member 628 against the urging of the tension member 620. An upper protrusion 594 on the rear plate 502 is inserted into the upper groove lip 596 and the rear plate 502 is set into place on connection bracket 504. The actuator bar 590 is then slid to the user's left to cause the locking tongue 616 to engage the lower groove lip 592.

The sliding plate 510 includes a pair of pivot arms 522, a pivot sleeve 528 and a pivot pin assembly 524. The pivot sleeve 528 is pivotally attached to the pivot arms 522. The pivot arms 522, the pivot sleeve 528 and pivot pin assembly 524 create a force to overcome mechanism which includes a pivot pin 646 extending through the transversely extending pivot sleeve 528 which carries a pivoting carriage assembly 532.

Two washers 548, 550 are seated on the ends of the pivot sleeve 528 and fit between the pivot sleeve 528 and arms 522. The sleeve 528 includes first and second transversely extending channels or grooves 668*a* and 668*b* on the interior surface thereof. The pivot pin 646 also extends through openings 523 in pivot arms 522 to connect the sliding plate assembly 510 and the carriage assembly 532 in hinged fashion.

The pivot pin 646 includes one or more bores 650 (two in the embodiment shown) extending transversely with respect to the pivot axis 670. Each of the bores 650 includes one or more (four in the embodiment shown) spring washers 664 (e.g., wave disc springs, Belleville washers, curved disc springs, etc.) seated with the respective bore 650. Each bore includes a plug 649 seated over the wave springs to capture the wave springs within the bore 650. Each of the plugs 649 includes a radiused upper (in the orientation shown in FIG. 7) protrusion 648. The plugs 649 are sized such that the protrusions 648 will be urged upwardly and, absent any biasing force opposing the spring force of the spring washers 664 will stand proud of the outer surface of the pivot pin 646. The transverse sides of the protrusions 648 may be beveled to facilitate insertion of the pivot pin 646 carrying the plugs 649 into the sleeve 528. The pivot pin 646 does not rotate relative to the first pivoting segment 510 by virtue of the threaded rod 520 engaging an opening 652 in the facing one of the arms 522. The rod 520 secures the tilt adjustment knob 518 engaging an elongate or eccentric opening 654 in pivot plate 524.

In operation, the pivoting carriage assembly 532 is manually pivotable relative to the sliding plate assembly 510 about the pivot pin 646. The carriage assembly 532 may be pivoted downward until the protrusions 648 engage the channel 668*b* formed in the inner wall of the sleeve 528. The spring washers 664 urge the protrusions 648 into the channel 668*b* to secure the mount in the operative deployed position wherein the associated goggle will be positioned in front of the eye(s) of the user. When it is desired to move the goggles to the stowed position, the wearer applies a pivoting force to the goggles. When the force applied is sufficient to overcome the spring force of the spring washers 664, the plugs 649 will be moved inwardly against the urging of the spring washers. The goggles may be pivoted upward until the protrusions 648 are aligned with the channel 668*a* at which time the spring washers 664 will urge the protrusions 648 into the channel 668*a* and provide positive retention of the goggles in the stowed position. In a preferred embodiment, the channels 668*a* and 668*b* have a first curved radius and the protrusions 648 have a second radius, wherein the radius of the protrusions 648 is slightly larger than the radius of the channels 668*a*, 668*b*.

An angle or tilt adjustment knob 518 is also provided on the pivot pin assembly 524 for adjusting the tilt angle of the optical device 512. The angle or tilt adjustment knob 518 includes a threaded rod 520 rotatably engaging a mating threaded opening 652 in the pivot arm 522. The arm 522 rotates relative to the plate 524, which includes an elongate or curvate opening or slot 654 receiving the threaded rod 520. Loosening the knob 518 allows adjustment of the optics to a desired tilt angle according to the user's eye position and a desired line of sight, whereby the tilt angle may then be secured in the desired position by tightening the knob 518. Alternatively, the knob 518 may include a cam 519 received in opening 654, wherein the tilt angel is adjusted by changing the angular position of the knob 518 and cam 519.

A vertical adjustment lever 514 includes a threaded screw 656 which travels through an opening 658 and engages a cam lock 660. A spring washer 662, e.g., a Belleville spring washer, is interposed between the lever 514 and the sliding plate assembly 510, which is compressed to provide a locking tension when the lever 514 is pivoted to the locked position and uncompressed when the lever is in the unlocked position. The cam lock 660 interfaces with the vertical adjustment plate assembly 506 of the rear plate 502.

When the lever 514 is in the unlocked position, the elongate dimension of the cam lock 660 extends parallel to the channel defined between the parallel rails 622 allowing the assembly 510 to slide freely up and down to provide an infinitely adjustable vertical adjustment mechanism. In addition, the tension is released in the spring washer 662, allowing the cam lock 660 to move slightly upward. When the assembly 510 is at a desired vertical position relative to the plate 506 (e.g., when an attached viewing device is at the correct vertical position relative to the eyes of the user), the lever 514 is pivoted to the locked position.

When the lever 514 is turned to the locked position, the cam lock 660 interacts with the locking rails 622 of plate 506 securing the vertical adjustment assembly 510 in the desired position. In the depicted preferred embodiment, the cam lock 660 has ears (not shown) extending in the elongate direction of the cam lock 660. The rails 622 cooperate with the plate 506 to define a generally T-shaped channel. The rails 622 may include a ramped or beveled edge to facilitate sliding movement of the ears (not shown) into the T channel as the lever 514 is rotated to the locked position. As the cam lock 660 is rotated, the ramped surface of the T-channel draws the cam lock 660 downward, compressing the spring washer 662 (not shown) and thus providing a tensioning force to secure the lever 514 in the locked position. As an alternative to or in addition to the ramped surface of the T channel defined by the rails 622, the ears (not shown) could also be ramped or beveled to facilitate movement into the T-channel as the lever 514 is pivoted to the locked position.

Movement of the vertical adjustment assembly 510 enables adjustment of the vertical position of an optical device relative to the wearer's eye position and desired line of sight. Once a desired vertical position is located, the lever 514 is moved back to a locked position and the cam lock 660 engages with locking rails 622 preventing vertical movement of the assembly 510. In this manner, using the vertical adjustment lever 514 and tilt adjustment knob 518 an attached optical device 512 can be positioned to a desired vertical position before the eye of the user. In the depicted embodiment, the optical device 512 is positioned before the right eye of the user.

A horizontal fore and aft adjustment assembly 532 is attached to the pivot sleeve 528. The horizontal fore and aft adjustment assembly 532 includes a fore and aft sliding arm 534, a slide carriage 536, a release button 538, a left and right sliding arm 544, an adjustment knob 554, and a helmet interface assembly 546. The sliding arm 534 is attached to the pivot sleeve 528 via a mechanical fastener 674. The exterior of the sliding arm 534 has a plurality of ridges 540 (eighteen in the embodiment shown) and fits within the opening of the slide carriage 536 having a release button 538. When the release button 538 is depressed the slide carriage 536 may be moved fore or aft along the sliding arm 534. When the user moves the optical device 512 into the desired position by sliding the slide carriage 536 along the sliding arm 534, and releases the button 538, the slide carriage 536 engages the plurality of ridges 540 associated with its position and locks the optical device 512 into the desired fore/aft position. The user may customize the fore and aft sliding arm 534 by attaching a stop 672 to the bottom of the sliding arm 534. The addition of the stop 672 enables a user to easily position the optical device 512 into the desired fore/aft position after the optical device 512 has been moved away from the user's eye or placed in a stowed position by stopping the aft movement of the optical device 512 once the set position is reached.

Figure 8:
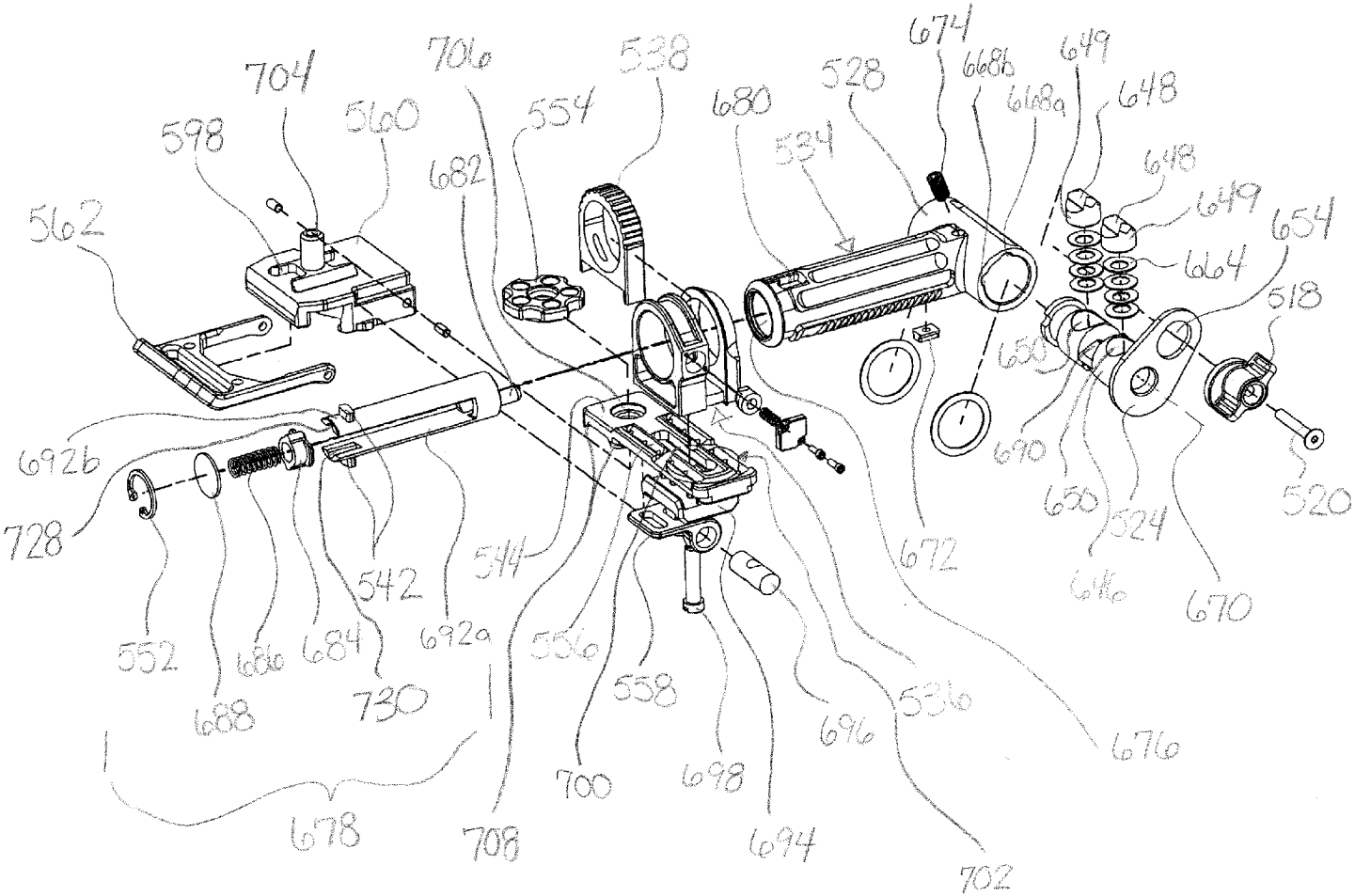
FIG. 8 is an enlarged exploded view illustrating the second pivoting segment and the left and right sliding arm assembly shown in FIG. 7.
Figure 9:
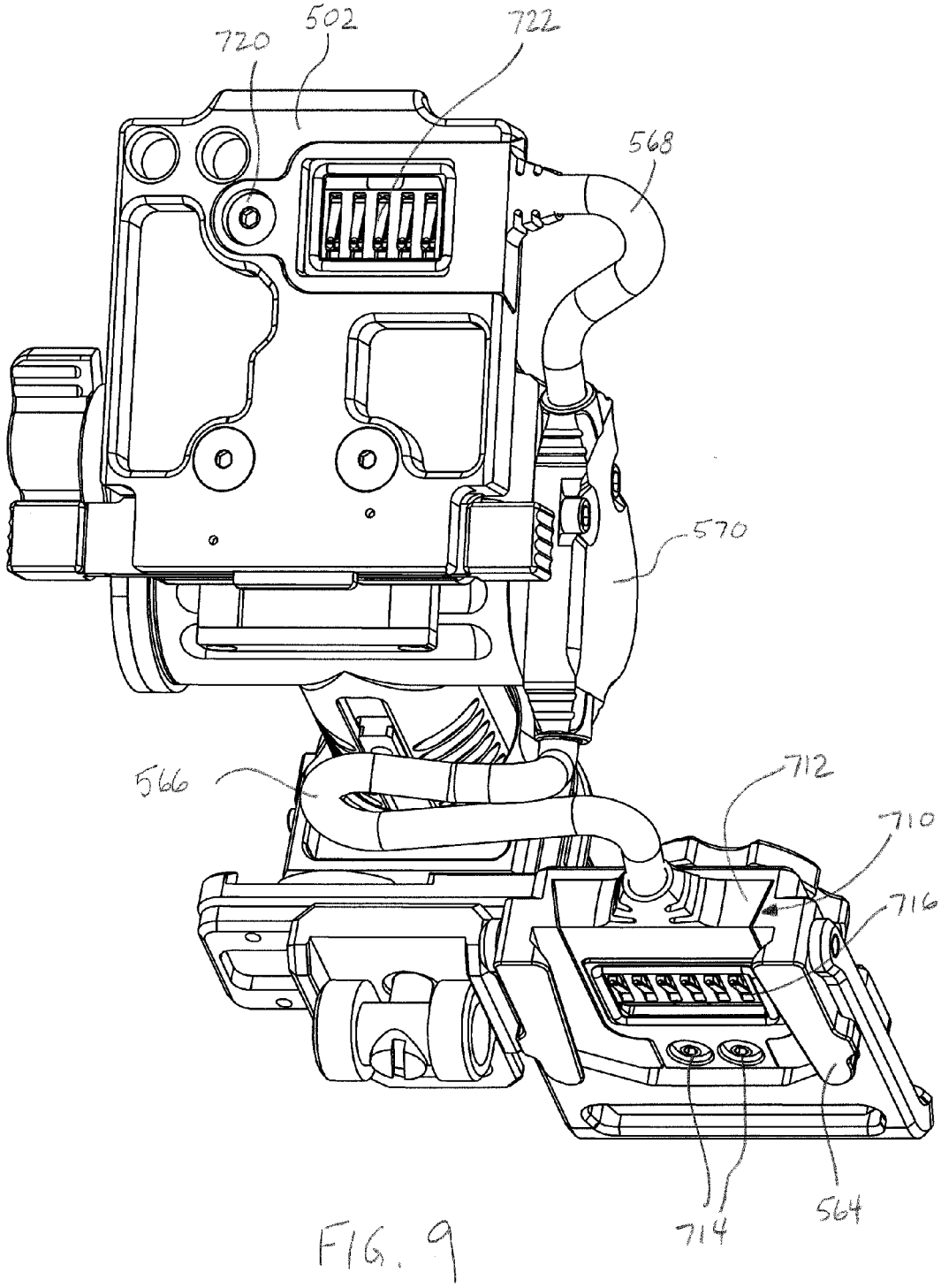
FIG. 9 is a rear, bottom isometric view of the mounting assembly shown in FIGS. 5 and 6.
Figure 10:
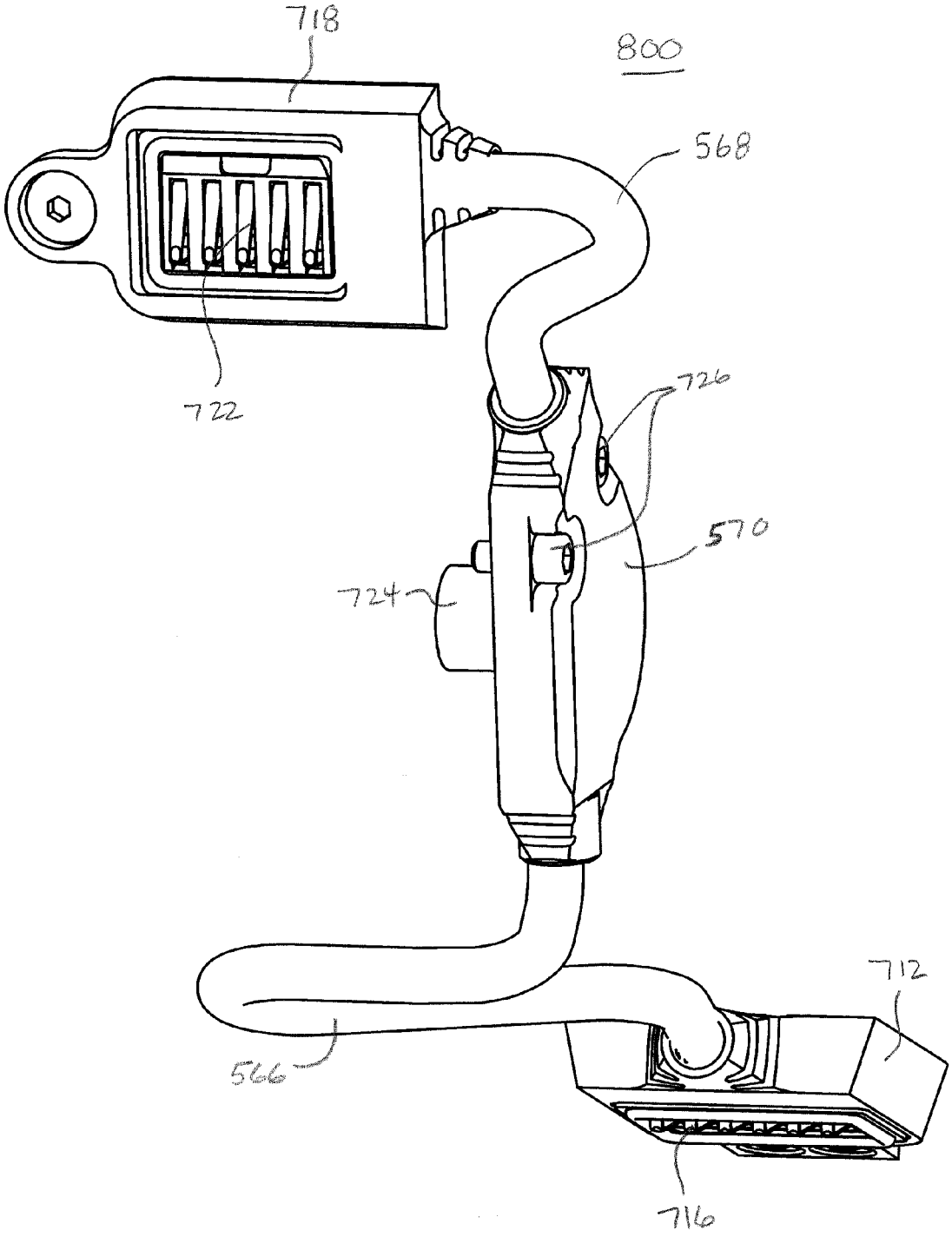
FIG. 10 is a rear, bottom isometric view of the power cable assembly of the illustrated helmet mount embodiment.
Figure 11:
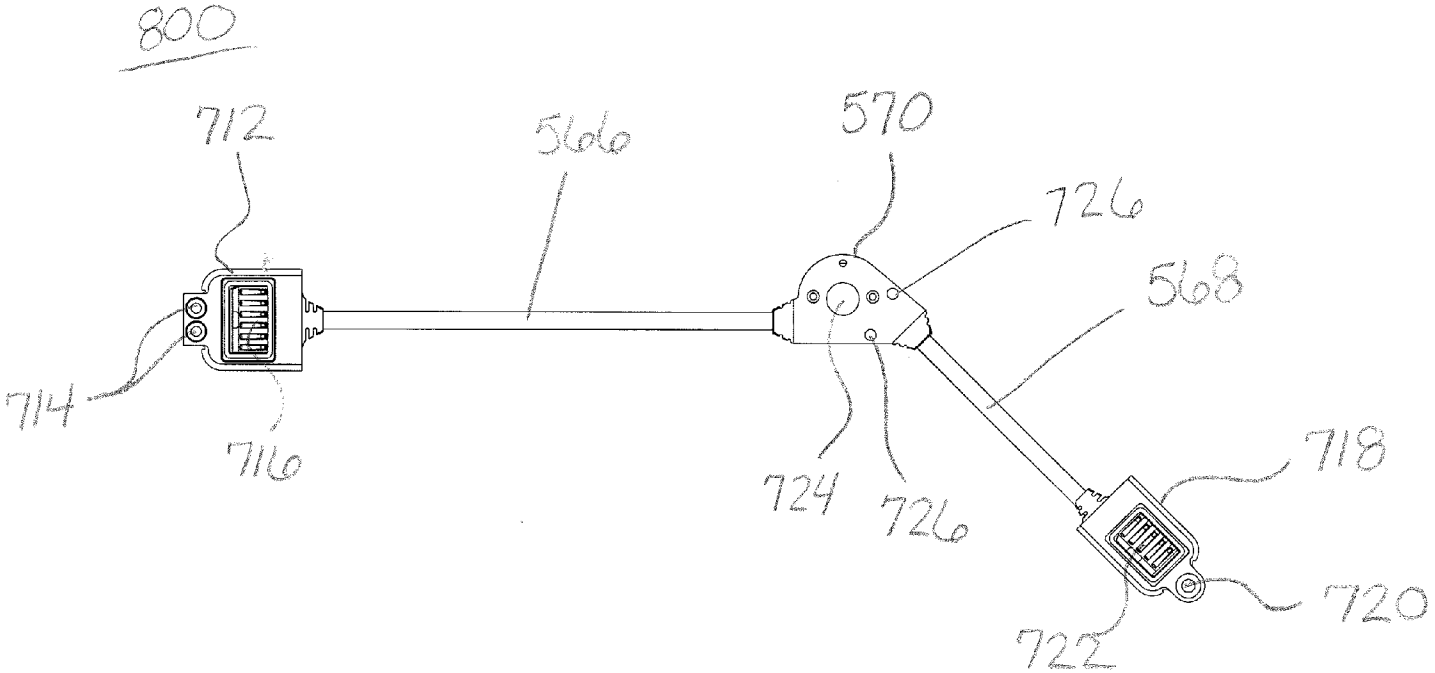
FIG. 11 is an elevational view of the power cable assembly appearing in FIG. 10.

As best seen in FIG. 8, the sliding arm 534 also has a cavity 676 which houses a position locking mechanism 678 having two arms 692*a*, 692*b*, at least one elongated protrusion 542 (two in the embodiment shown), a pin 682, a stop 684, a spring 686, a cover 688, and a fastener 552. The stop 684 engages channels 728 and 730 of arms 692*a*, 692*b* at one end and spring 686 at a second end between arms 692*a* and 692*b*. The cover 688 is secured to the opening in sliding arm 534 via fastener 552 thereby preventing any debris from entering the sliding arm 534. The arms 692*a*, 692*b* also prevent debris from entering the cavity 676 through elongated openings 680 by maintaining a constant closed position. The protrusions 542 run in the channel 680. When the carriage horn 534 is in the deployed, viewing position, the spring 686 urges the rearward and confines the bosses 542 to the rearward, axial-extending portion, thereby preventing rotation of the optical or viewing unit and carriage assembly when the mount is in the viewing or deployed position. When the sliding horn 534 is pivoted upward to the stowed position, the contour of the channel 690 acts on the pin 682 to urge the fork member carrying the bosses 542 forward against the bias of the spring 686 so that the bosses 542 enter the transverse portion of the channel 680, allowing the carriage assembly with attached viewing device to be rotated to the second stowed position. In other words, rotation of the carriage assembly with the viewing device is prevented while the device is deployed, such that rotation to the second stowed position can only be performed after the carriage horn 534 has been pivoted upward. In this manner, providing the carriage arm 534 having a generally circular cross-sectional shape allows both fore and aft adjustment, as well as rotation to a stowed position can be provided within a single joint, thereby reducing cost and complexity.

Figure 12:
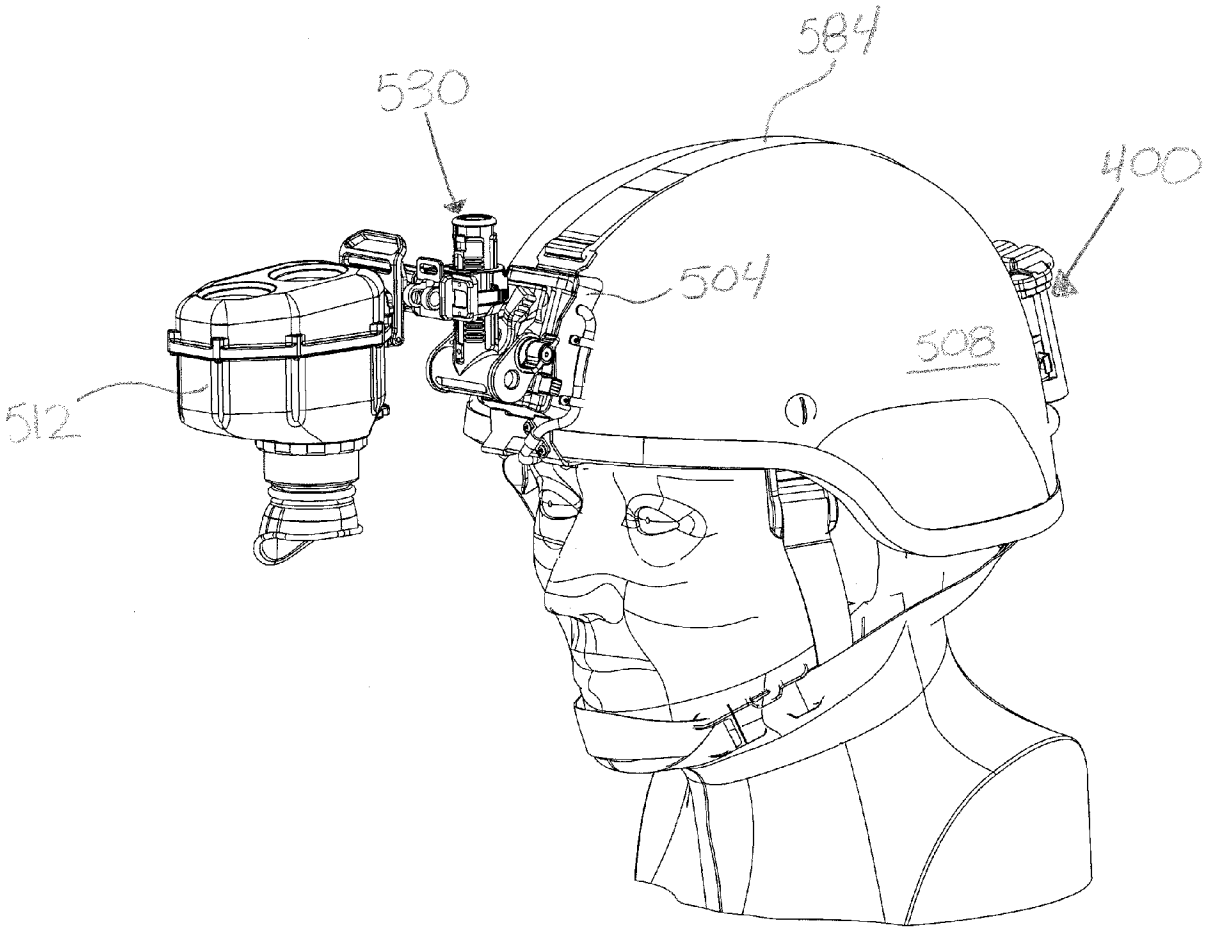
FIG. 12 is an isometric view of the embodiment shown in FIGS. 9-11, taken generally from the front and left side (from the perspective of the wearer) showing the optical device in a first stowed position.
Figure 13:
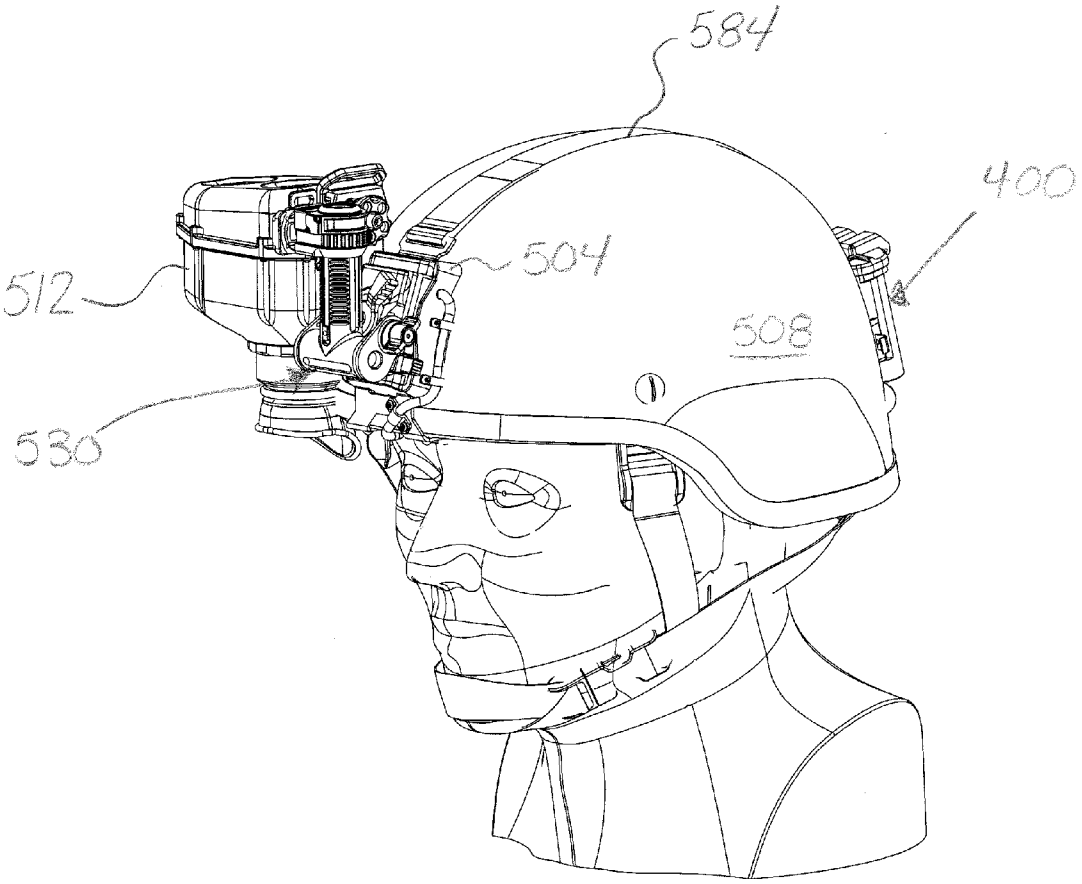
FIG. 13 is an isometric view of the embodiment shown in FIGS. 9-11, taken generally from the front and left side (from the perspective of the wearer) showing the optical device in a second stowed position.

In operation, a user wishing to lock the helmet mount assembly 530 in the operational position slides protrusions 542 against the urging of spring 686 to the fore position of elongated openings 680. When protrusions 542 are slid to a forward position the arms 692*a* and 692*b* move forward within sliding arm 534 and pin 682 slides out of engagement with a channel 690 on the pivot pin 646. When it is desired to move the optical device 512 to the stowed position, the wearer slides the protrusions 542 to the unlocked or aft position within elongated openings 680 thereby moving pin 682 to engage with channel 690. Once pin 682 engages channel 690 the user applies a pivoting force to the optical device 512. When the force applied is sufficient to overcome the spring force of the spring washers 664, the plugs 649 will be moved inwardly against the urging of the spring washers 664. The optical device 512 may be pivoted upward until the protrusions 648 are aligned with the channel 668*a* at which time the spring washers 664 will urge the protrusions 648 into the channel 668*a* and provide positive retention of the goggles in the stowed position. If the user desires a lower profile stowed position, the user may depress release button 538 and rotate the slide carriage 536 to place the optical device 512 closer to helmet 508. The two, alternative stowed positions are best seen in FIGS. 12 and 13.

Referring to FIG. 8, the bottom of the slide carriage 536 engages the left and right sliding arm 544 at rails 556. The slide arm 544 has a locking mechanism attached on its underside and the locking mechanism has a lever 558, a lock shim 694, a bushing 696, and a pin or drawbar 698. The user may adjust the horizontal position of the attached optical device 512 in the left and right direction by releasing the lever 558. The user pulls down the lever 558 to release the locking mechanism and in turn the lever 558 pulls pin 698 from channel 700 thereby releasing lock shim 694 from engagement with the bottom of sliding arm 544. Once the lever 558 is released, the user may freely move the slide carriage 536 left and right along the rails 556 of the sliding arm 544 to position the optical device 512 in the desired left/right position. Once the user has found the desired left/right position for the optical device 512, he flips the lever 558 up to the locked position and once again secures the shim 694 to the bottom of the sliding arm 544 thereby locking the optical device 512 into the desired position.

In addition, to left and right adjustment of the optical device 512 the sliding arm 544 also enables the user to rotate the optical device 512 from its depicted position in front of the user's right eye to a position in front of his left eye using the locking mechanism. By releasing the lever 558 the user may slide the slide carriage 536 to engage circular channel 702 which disengages the teeth (not shown) on the bottom of slide carriage 536 enabling the user to rotate the slide arm 544 180 degrees from in front of the right eye, as shown in FIGS. 1-3, to in front of the user's left eye and vice versa. Once the optical device 512 is on the desired side, the user moves the lever 558 back to its locked position. In order for the optical device 512 to be operational once moved to the user's left eye the user must also rotate the position of the helmet interface assembly 546 thereby rotating the optical device 512, which is described in greater detail below.

The helmet interface assembly 546 is secured to the sliding arm 544 via a knob 554 and a pin 704. The pin 704 is inserted into opening 706 of the slide arm 544 and knob 544 is screwed onto the pin 704 to secure the power interface 560 of the helmet interface assembly 546 to the sliding arm 544. A protrusion 598 on the top of the power interface 560 engages the rails 708 of the slide arm 544 to prevent the helmet interface assembly 546 from rotating during operation. When the user changes the side that the optical device 512 is on the user must rotate the sliding arm 544 180 degrees, as described above, and he must also rotate the interface assembly 546 180 degrees. In order to rotate the interface assembly 546 the user loosens the knob 544 which disengages the protrusion 598 from the rails 708 thereby enabling the interface assembly 546 to freely rotate the necessary 180 degrees. Once the interface assembly 546 rotates to place the optical device 512 in the desired operational position, the user tightens the knob 554 and once again secures the protrusion 598 between the rails 708 to prevent the interface assembly 546 and attached optical device 512 from rotating during operation.

The helmet interface assembly 546 also includes a mounting shoe receiver 564 and a lever 562. The mounting shoe receiver 564 has a channel 710 for receiving a first interface 712. Once the first interface 712 is inserted into the channel 710 it is secured to the mounting shoe receiver 564 via fasteners 714. When the optical device 512 is secured to the mounting shoe receiver 564 the first interface 712 provides power to the optical device 512 through the electrical contacts (not shown) of its mounting shoe (not shown). The optical device 512 is secured to the interface assembly 546 by releasing the lever 562, inserting the mating mounting shoe (not shown) of the optical device 512 into the mounting shoe receiver 564 and closing the lever 562. To remove the optical device 512 from the mounting shoe receiver 564 the user releases the lever 562 and slides the mounting shoe (not shown) from the mounting shoe receiver 564. The first interface 712 has contacts 716 electrically coupled to the power supply 400 and providing power to an attached optical device 512.

The optical device 512 is electrically coupled to the power supply 400 via a replaceable power harness 800. The replaceable power harness 800 enables a user to easily replace the power harness 800 if it becomes damaged during use. The power harness 800 includes a first interface 712, connection interface 570, a second interface 718, and multiconductor cables 566 and 568. The first interface 712 is coupled to mounting shoe receiver 564 as discussed above. The connection interface 570 has a pin 724 which fits in pivot pin 646 and is secured to pivot arm 522 via fasteners 726. The second interface 718 is coupled to the back side of rear plate 502 via fastener 720. The first interface 712 is coupled to the connection interface 570 via multiconductor cable 566 and the connection interface 570 is coupled to the second interface 718 via multiconductor cable 568. The first interface 712 and the second interface 718 have electrical contacts 716 and 722, respectively. The power harness 800 is coupled to the bracket 504 via contacts 722 of the second interface 718 on rear plate 502 and contacts 576 on the bracket 504. The contacts 576 inside the bracket 504 are electrically coupled to the cable 572. The cable 572 exits the bracket 504 and travels along its exterior and under the front side of helmet 508 between the hook members 578. On the underside of helmet 508, the cable 572 connects with the flat cable 574. The cable 574 travels along the inside of the helmet 508 and between hook members 580, wherein the cable 574 connects with a multiconductor cable 582 which is then coupled to the power supply 400 as described above.

In preferred embodiment, the helmet mount 530 includes an automatic shutoff for the optics when the pivot sleeve 528 is pivoted out of the viewing position to preserve the battery power when the optics are not being used, e.g., using a point magnet and a magnet proximity sensor as described above. For example, in a preferred automatic shutoff embodiment a magnet (not shown) is housed within the pivoting sleeve 528 and a reed switch, Hall effect sensor, or the like is housed within the connection interface 570, such that when the helmet mount is in the normal deployed position, i.e., in the lowest detent position, the magnet is in proximity with the sensor. Once mount is pivoted to the stowed position, i.e., when the user flips the mount up, the magnet no longer engages the reed switch or other magnetic sensor in the sleeve 528 and power to the optics or other device is shut off.

The optical device 512 may be a monocular night vision goggle device, and may advantageously be an eNVG device. However, it will be understood that the invention can be used with other types of sighting devices, such as a monocular or binoculars, helmet mounted display screen, head-up display or any other helmet mounted optical, electro-optical, and/or viewing devices.

A strap 584 includes a first end connected to the bracket 504 and a second end coupled to a rear bracket 586. The bracket 504 has hook members 578 and the rear bracket 586 has hook members 580. The hook members 578, 580 may include rubber pads or grommets 579 as described above. The hook members 578 and 580 may be removably secured to the helmet by wrapping about the front and rear brim portions of the helmet 508, respectively. If desired, the strap 584 may be adjustable, e.g., via a ratchet or other adjustable mechanical linkage (not shown) so as to be adapted for use with different sized helmets.

Figure 15:
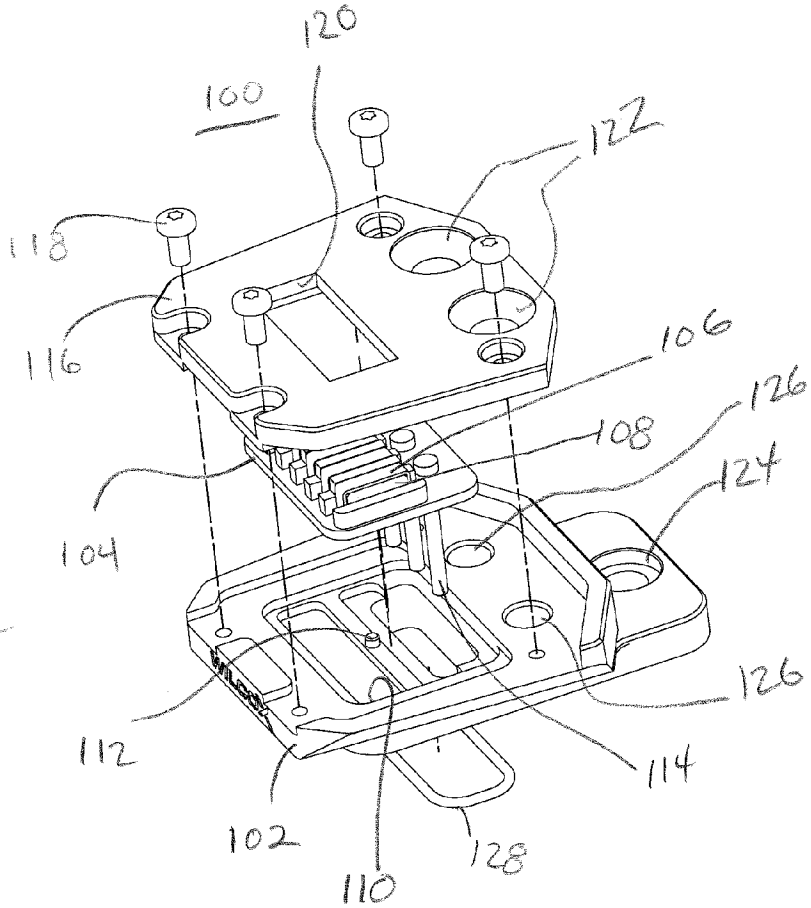
FIGS. 14 and 15 are isometric and exploded views of a first embodiment modular mounting shoe assembly.
Figure 14:
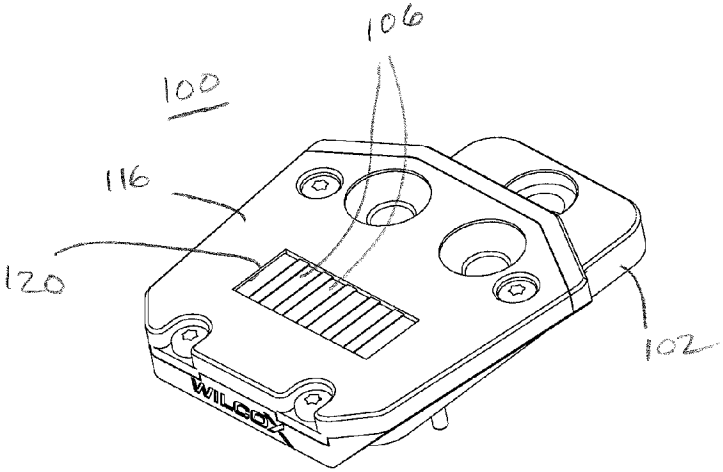

Referring now to FIGS. 14 and 15, there appears a first embodiment mounting shoe assembly 100 including a base 102, which is preferably made of a metal or metal alloy receiving a circuit board 104 with a plurality of electrical contacts or terminals 106 mounted to a spacer block or insulator block 108 on the board 104. The board is received within a cavity or opening 110 within the base 102. An alignment pin 112 may be provided which engages a complimentary depression or cavity on the board to ensure proper alignment of the board when it is assembled to the base. Conductive pins on the board 104 are electrically coupled to the contacts 106 and extend in protruding fashion through the opening 110 and mate with an aligned electrical connector on the optical device or other device when the mounting shoe assembly 100 is attached thereto. A top cover 116 is secured to the base member 102, e.g., with threaded fasteners 118 and includes an opening 120 exposing the contacts 106. A sealing ring or gasket 128 provides a sealing interference between the bottom of the base 102 and the night vision or other device to which the mounting shoe assembly is attached and the entire unit may be potted with a glue or other potting material. Threaded fasteners (not shown) are used to secure the mounting shoe assembly 100 to a device via the openings 122 in the top cover, aligned openings 126 in the base 102 and the opening 124 in the base. In the depicted embodiment, the contacts 106 are flat contacts adapted to make electrical contact with a spring contact, such as the contacts 716 on the mounting shoe receptacle 564, described above. It will be recognized that the assembly 100 could be modified to employ spring contacts instead of flat contacts. It is preferred, however, that the mounting shoe assembly 100 adapted for generally permanent attachment on a night vision device or other device to be powered employ flat contacts to minimize the potential for damage to the contacts. In the depicted preferred embodiment, the board 104 has six contacts 106. This allows for redundant power contacts, e.g., two positive, two negative, as well as two data or signal contacts. By providing multiple positive and negative power terminals, power can still be supplied to the device, even where on of the contacts is damaged or otherwise not making electrical contact with the aligned contact on the mounting shoe receiver.

Figure 17:
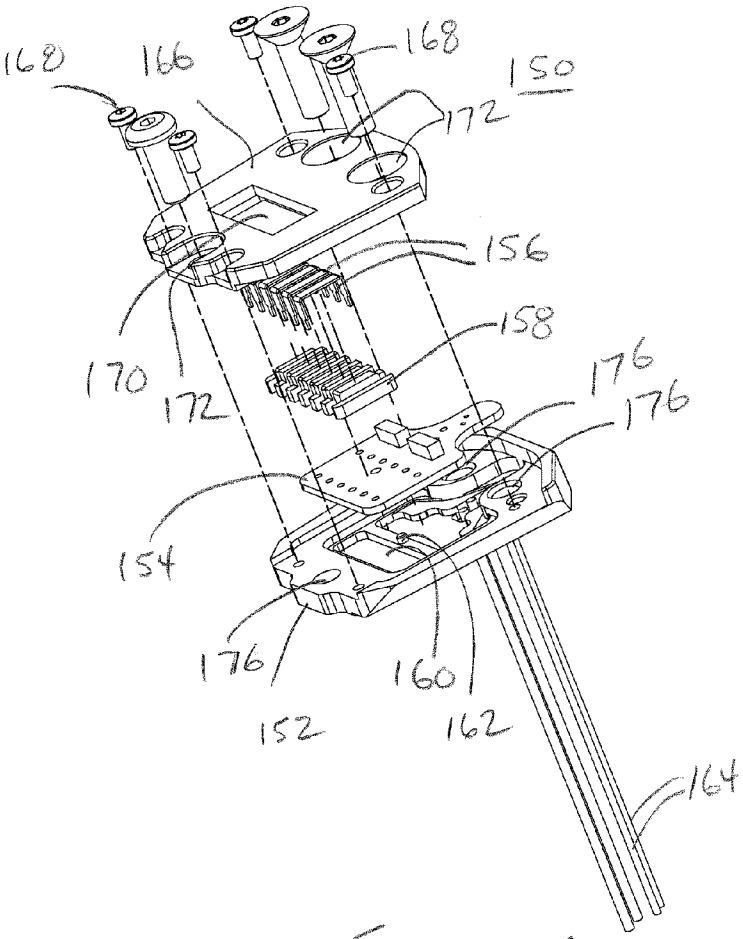
FIGS. 16 and 17 are isometric and exploded views of a second embodiment modular mounting shoe assembly.
Figure 16:
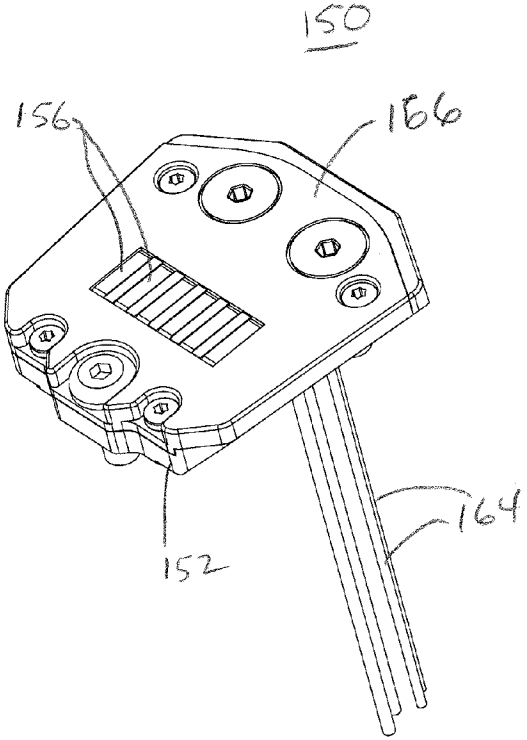

Referring now to FIGS. 16 and 17, there appears a second embodiment mounting shoe assembly 150 including a base 152, which is preferably made of a metal or metal alloy receiving a circuit board 154 with a plurality of electrical contacts or terminals 156 mounted to a spacer block or insulator block 158 on the board 154. The board 154 is received within a cavity or opening 160 within the base 152. An alignment pin 162 may be provided which engages a complimentary depression or cavity on the board (not shown) to ensure proper alignment of the board when it is assembled to the base 152. A plurality of wires 164 on the board 154 are electrically coupled to the contacts 156 and extend through the base for electrical coupling to the circuitry of the viewing device or other device to be powered. A top cover 166 is secured to the base member 152, e.g., with threaded fasteners 168 and includes an opening 170 exposing the contacts 156. A sealing ring or gasket may be provided to provide a sealing interference between the bottom of the base 152 and the night vision or other device to which the mounting shoe assembly is attached and the entire unit may be potted with a glue or other potting material. Threaded fasteners 180 are used to secure the mounting shoe assembly 150 to a device via the openings 172 in the top cover and aligned openings 176 in the base 152 and the opening 174 in the base. In the depicted embodiment, the contacts 156 are flat contacts adapted to make electrical contact with a spring contact, such as the contacts 716 on the mounting shoe receptacle 564, described above. It will be recognized that the assembly 150 could be modified to employ spring contacts instead of flat contacts. It is preferred, however, that the mounting shoe assembly 150 adapted for generally permanent attachment on a night vision device or other device to be powered employ flat contacts to minimize the potential for damage to the contacts. In the depicted preferred embodiment, the board 154 has six contacts 156. This allows for redundant power contacts, e.g., two positive, two negative, as well as two data or signal contacts. By providing multiple positive and negative power terminals, power can still be supplied to the device, even where on of the contacts is damaged or otherwise not making electrical contact with the aligned contact on the mounting shoe receptacle.

Figure 19:
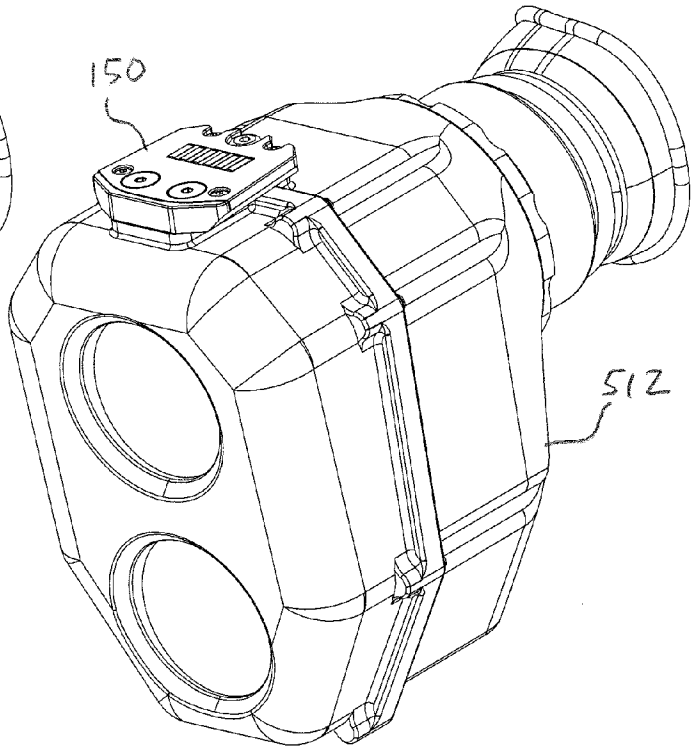
FIGS. 18 and 19 are partially exploded and isometric views illustrating the manner of attachment of the modular mounting shoe assembly to a viewing device.
Figure 18:
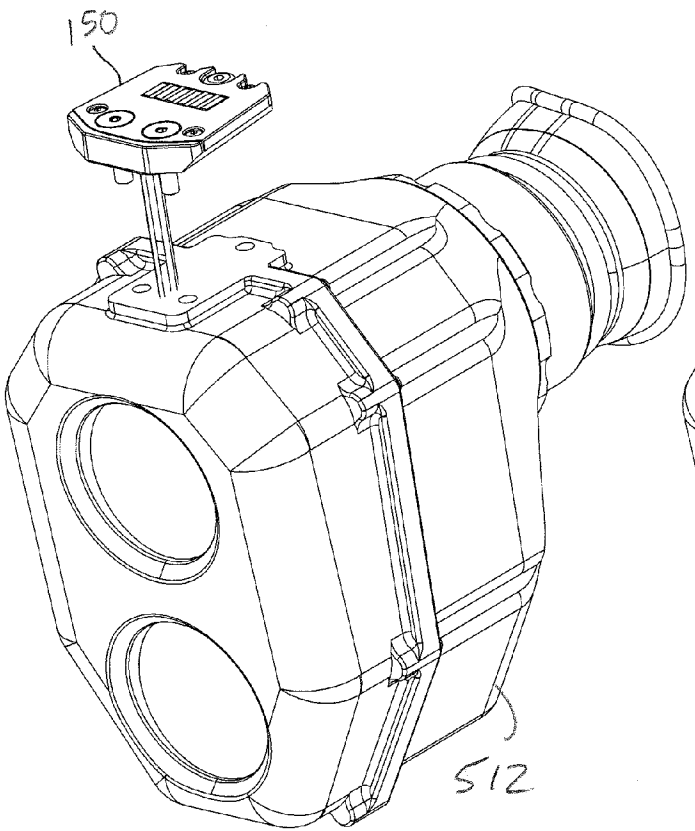
Figure 20:
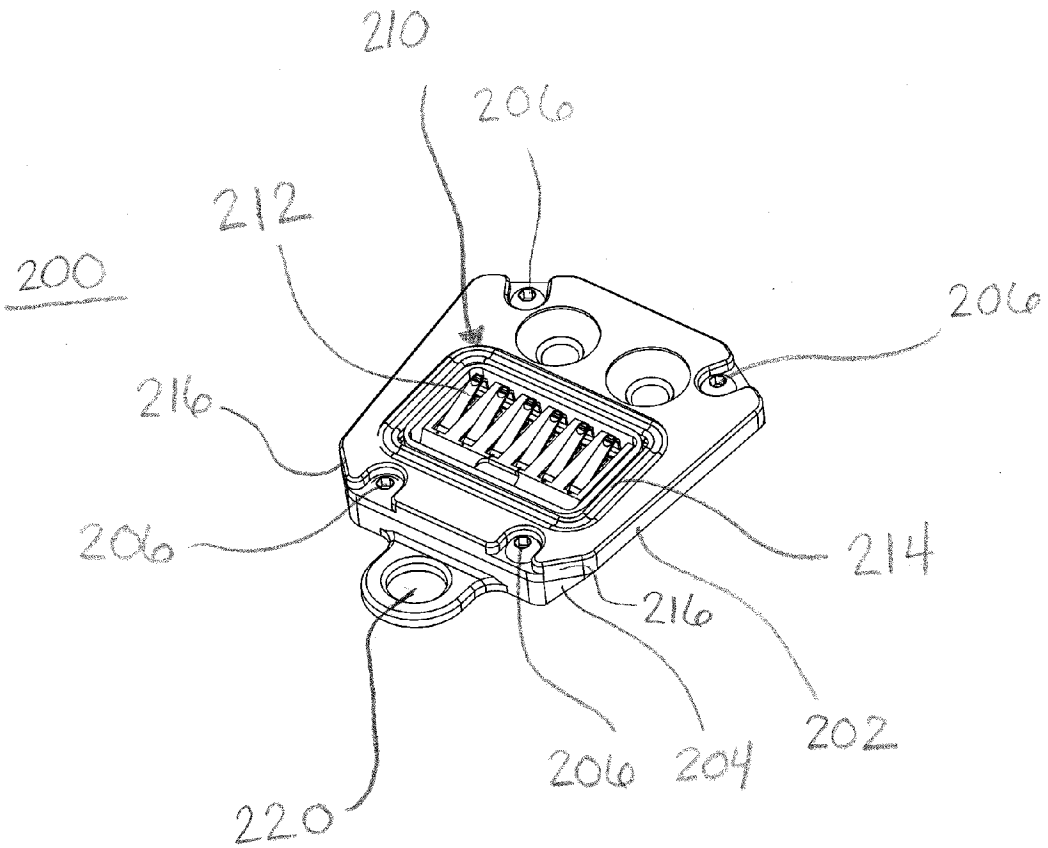
FIG. 20 is a front isometric view front view of a modular mounting shoe assembly according to a third exemplary embodiment of the present invention.
Figure 21:
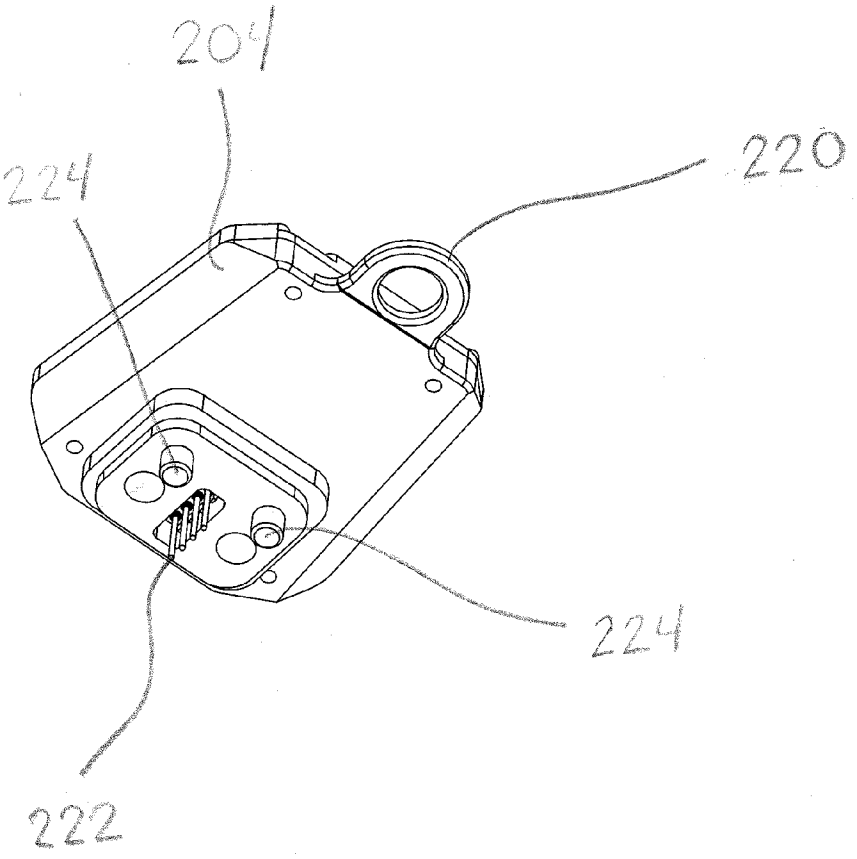
FIG. 21 is a rear isometric view of the modular mounting shoe assembly appearing in FIG. 20.

Referring now to FIGS. 18-19, there appears a third embodiment the modular mounting shoe assembly 200, which may be mounted to a helmet mount system for connection of a power source 300 to an optical device 112. The mounting shoe assembly 200 includes a first plate 202 and a second plate 204 which are secured via mechanical fasteners 206, such as screws, rivets, clips, dogs, pawls, or the like. The first plate 202 includes an opening 210 whereby a contact plate containing the conductive electrical contacts 212 extends through the first plate 202 of the mounting shoe assembly 200 enabling an electrical connection to a power supply 300 or an optical device 112. One or more sealing rings or gaskets 214 may be provided between the first plate 202 and the contacts 212 to provide a sealing interference therebetween. The sealing rings or gaskets 214 also may be provided to provide a seal against moisture or other contamination.

The second plate 204 includes an opening 220, four terminal connections 222, and alignment pins 224. The opening 220, in addition to openings 226 in the top cover and aligned openings 228 on the base 204 are provided for attachment of assembly 200 to the device such as an optical device 112, e.g., with threaded fasteners. The four terminal connections 222 are each connected to the cable 144 to deliver electric power from the battery pack 300 to a device requiring power for operation, such as the optical device 112. The cable 144 may be passed through a hole drilled in the helmet and is electrically coupled to the front bracket 104. Power is transferred from a power supply 300 into the mounting shoe 200 via the contacts 212, and then out of the mounting shoe 200 via terminal connections 222 to the cable 144 which travels across the helmet 108 as described above providing power to a device, such as the optical device 112. The alignment pins 224 may be provided to align the mounting shoe assembly 200 with a mounting member having complimentary recesses (not shown) on the helmet mount strap 134. Although the contact 212 are shown as spring contacts, it will be recognized that the contacts could also be flat contacts as described above.

Figure 22:
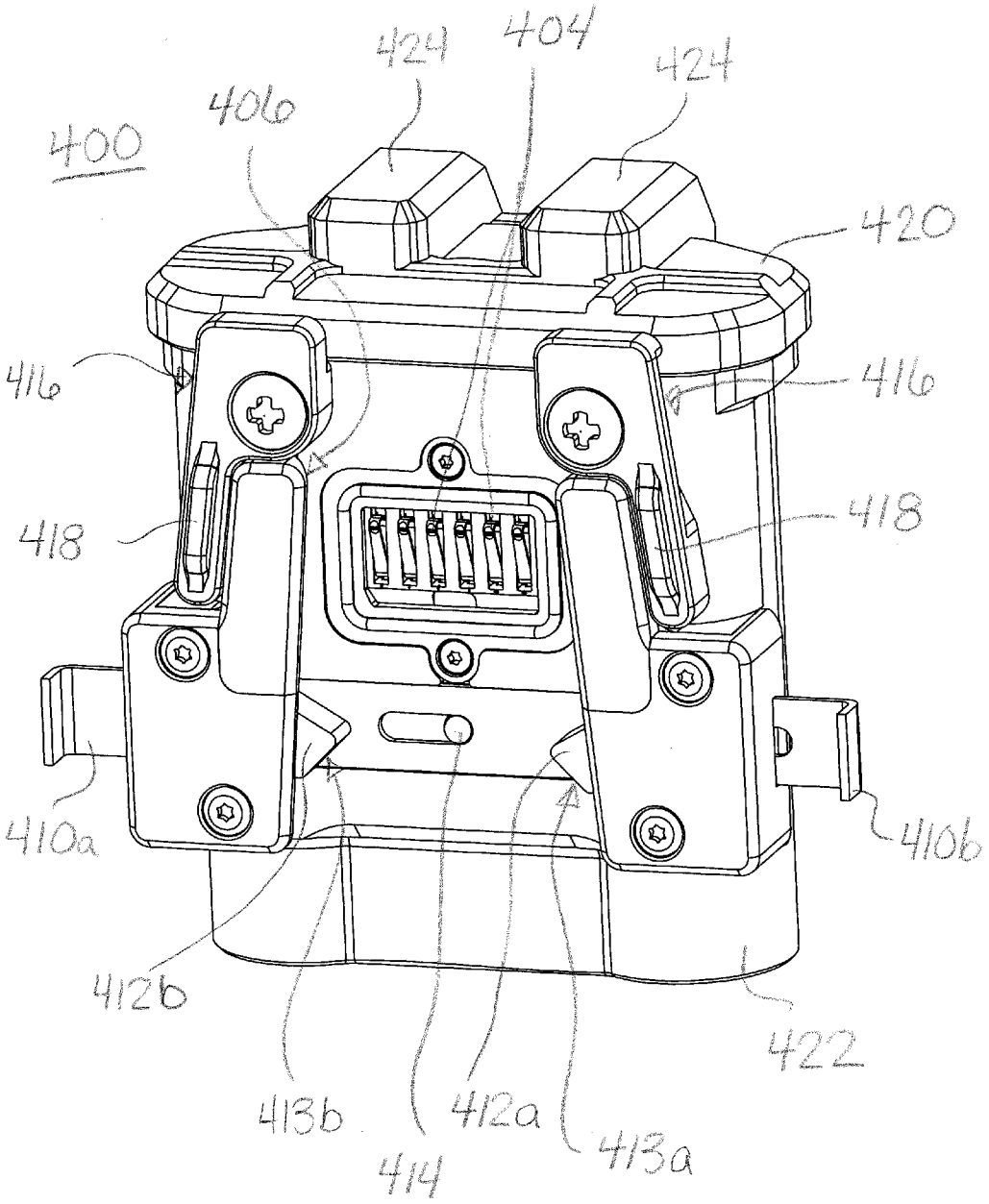
FIG. 22 is an isometric view of an exemplary embodiment power supply, illustrating the mounting shoe assembly.
Figure 23:
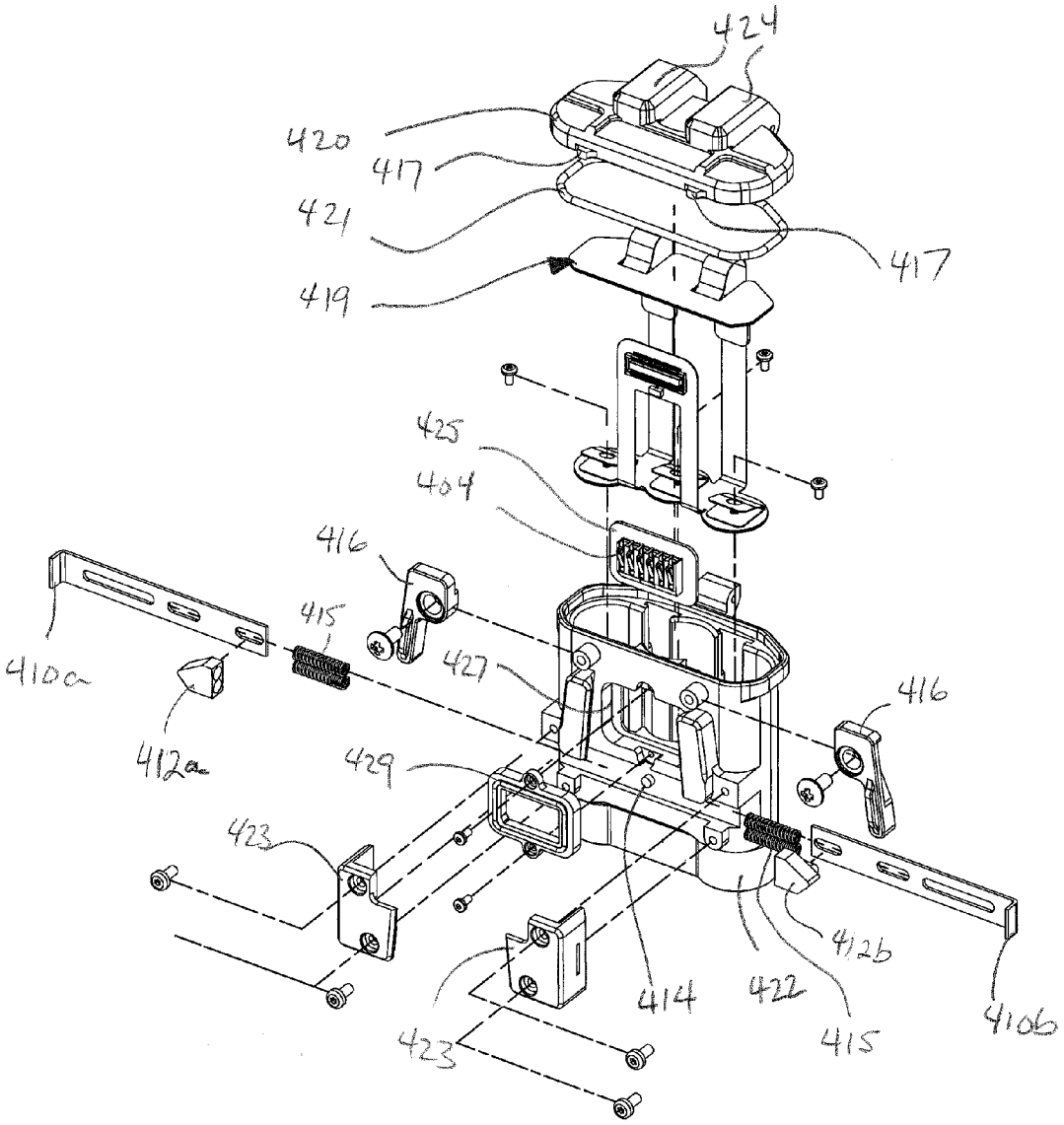
FIG. 23 is an exploded view of the power supply appearing in FIG. 22.

Referring now to FIGS. 22 and 23, an exemplary power supply 400 is shown. The power supply may be of the type described in U.S. provisional patent application Ser. No. 61/332,225 filed on May 7, 2010. The aforementioned application is incorporated herein by reference in its entirety. The exterior of the power supply 400 includes electrical contacts 404, which are shown as spring contacts (although the use of flat contacts are also contemplated when the mating mounting shoe receptacle is to have spring contacts. A mounting shoe receiver 406 is provided on the housing 422 for removable connection to mating mounting shoe assembly, such as the mounting shoe on the rear portion of the helmet strap assembly as described above. The array of contacts 404 contact a set of contacts on the battery dock portion of the rear bracket 586, wherein the battery dock may be a mounting shoe substantially as described above by way of reference to the mounting shoes appearing in FIGS. 14-21.

A locking mechanism 416 includes levers for releasable securing the cover 420 over the main housing body 422 in closed position. One or more hinge members 424 (two in the embodiment shown) are provided to pivotally attach the housing cover member 420 to the housing body 422. The mounting shoe receiver 406 of the power supply 400 also contains a locking or release assembly having tabs 410*a*, 410*b*, protrusions 412*a*, 412*b*, and an alignment pin 414.

To secure the power supply 400 to the mounting shoe 200, the mounting shoe receiver 406 contains a locking assembly having tabs 410*a*, 410*b*, protrusions 412*a*, 412*b*, and an alignment pin 414. The tabs 410*a*, 410*b* and protrusions 412*a*, 412*b* are resiliently biased via captured springs 415 to engage the mounting shoe 200 when the power supply 400 is slid into place. The springs are captured via cover members 423 secured to the housing 422.

To remove the power supply 400 from the mounting shoe 200, the tabs 410*a*, 410*b* are squeezed together against the bias of the springs 415 to manually disengage the protrusions 412*a*, 412*b* of the locking assembly. The protrusions 412*a* and 412*b* extend into the channel defined by the mounting shoe receiver 406. The protrusion 412*a* is carried on the sliding tab 410*a* and the protrusion 412*b* is carried on the sliding tab 410*b* such that inward squeezing of the tabs 410*a* and 410*b* causes outward movement of the protrusions 412*a* and 412*b*, thus enabling removal of the power supply 400 from the mounting shoe 200. The alignment pin 414 extends through elongate openings in the tabs 410*a* and 410*b* to align the tabs and limit the extent of sliding movement of the tabs 410*a* and 410*b*.

The mounting shoe receiver 406 and mounting shoe 200 may be of tapered, dove-tail configuration. In the depicted embodiment, the mounting shoe portion 200 includes angled or ramped edges 216 which engage aligned ramped edges 413*a*, 413*b* of the protrusions 412*a*, 412*b*, respectively, to urge the protrusions in the transverse outward direction to allow the shoe 200 to slide therepast when the power supply 400 is connected to the mounting shoe 200. The power supply 400 contains a locking mechanism 416 having lever locks 418 which pivot to releasably engage tabs 417 on the housing cover 420 to secure the top 420 to body 422 in a locked and closed position and to retain the plurality of batteries 340 (three in the embodiment shown, although other numbers of batteries are contemplated) within the housing 422 of the power supply 400. A sealing ring or gasket may be provided between the cover 420 and the housing 422 to prevent entry of moisture or environmental contamination.

As best seen in FIG. 23, a plurality of batteries (preferably 2, 3, or 4) are received within the housing 422. Although a three-battery embodiment is shown in the depicted embodiment, other numbers of batteries are contemplated. The electrical contacts 404 on the mounting shoe receiver 406 are electrically coupled to a device to be operated. The contacts are located on a board 425 and secured in an opening 427 in the housing 422 via a bezel 429. The housing additionally encloses the circuitry including a flexible circuit 419 on a flexible substrate to electrically couple the battery terminals t5*o* the contacts 404 in a desired circuit configuration and as described in greater detail in the aforementioned U.S. provisional application Ser. No. 61/332,225, Advantageously, the device to be powered may be an optical device, such as, a monocular or binoculars, a monocular or binocular night vision goggle device, eNVG devices, helmet mounted display screens, head-up displays or any other helmet mounted optical, electro-optical, and/or viewing devices, attached to a helmet mounting system. It will be understood, however, that the power supply herein can be used to provide electrical power to all manner of electrical and electronic devices.

The invention has been described with reference to the preferred embodiments. Modifications and alterations will occur to others upon a reading and understanding of the preceding detailed description. Therefore, it is not desired to limit the invention to the specific examples disclosed or the exact construction and operation shown and described. Rather, all suitable modifications and equivalents may be resorted to, falling within the scope of the invention.

Having thus described the prefered embodiments, the invention is now claimed to be:

1. A mounting device for mounting an optical device on a helmet, said mounting device comprising:

a mounting assembly removably attachable to the helmet;

a pivoting assembly having a first end pivotally attached to said mounting assembly and a second end opposite the first end;

a fore and aft adjustment assembly attached to said second end of said pivoting assembly;

a left and right adjustment assembly rotatably attached to said fore and aft adjustment assembly, wherein said left and right adjustment assembly is selectively rotatable at least 180 degrees relative to the fore and aft adjustment assembly about a first generally vertical axis; and an optical device mounting member rotatably attached to said left and right adjustment assembly, said optical device mounting member removably attachable to the optical device, wherein said optical device mounting member is (a) selectively movable in a generally horizontal transverse direction relative to a user's line of sight and (b) selectively rotatable at least 180 degrees relative to the left and right adjustment assembly about a second generally vertical axis;

wherein said left and right adjustment assembly includes:

a sliding arm having a first opening adjacent a first end and a second opening adjacent a second end;

a first pin extending through the first opening and rotatably securing the optical device mounting member to the sliding arm;

a second pin extending through the second opening and securing the sliding arm to the fore and aft adjustment assembly, the second opening being elongated in a transverse direction relative to a line of sight of a user, the sliding arm being selectively slidable in said transverse direction in relation to the fore and aft adjustment assembly; and a locking mechanism on said sliding arm for securing said sliding arm at a desired transverse position.

2. The mounting device of claim 1, wherein said mounting assembly includes a vertical adjustment mechanism, said vertical adjustment mechanism including a base plate, a pair of guide rails attached to said base plate and defining a channel therebetween, a sliding plate slidably attached to said guide rails, and a clamping mechanism for selectively applying a clamping force to secure said sliding plate at a desired position relative to said base plate.

3. The mounting device of claim 1, further comprising:

a tilt adjustment mechanism for adjusting a tilt position of the associated optical device relative to an eye of a user.

4. The mounting device of claim 1, wherein said fore and aft adjustment assembly includes an arm, a sliding carriage slidably attached to said arm, and a push button attached to said sliding carriage for providing a generally horizontal fore and aft adjustment of the optical device when the mounting device is in an operational position.

5. The mounting device of claim 4, wherein said arm has a generally circular cross-sectional shape.

6. The mounting device of claim 4, wherein said sliding carriage is rotatable about said arm when said pivoting assembly is pivoted to a stowed position.

7. The mounting device of claim 4, further comprising:

a locking lever for securing said left and right adjustment assembly to said sliding carriage on said fore and aft adjustment assembly.

8. The mounting device of claim 1, further comprising:

a bracket configured to be attached to a helmet; and said mounting assembly removably attached to said bracket.

9. The mounting device of claim 8, further comprising:

a strap wherein said strap is attached at a first end to said bracket which is secured to a front side of said helmet and said strap is attached at a second end to a rear bracket which is secured to a rear side of said helmet.

10. The mounting device of claim 9, further comprising:

a mounting shoe receiver on said rear bracket for attaching a power source to provide power to said optical device.

11. The mounting device of claim 1, wherein said pivoting assembly rotates between a first, operational position before the eyes of a user donning the helmet and a second, stowed position above a line of sight of a viewer donning the helmet.

12. The mounting device of claim 11, wherein said fore and aft adjustment assembly rotates between a first, stowed position above said line of sight of said viewer donning the helmet and a second, stowed position above said line of sight of said viewer and rotated to be in close proximity to the helmet.

13. The mounting device of claim 1, wherein said optical device mounting member includes a mounting shoe receiver for removably receiving a complimentary mounting shoe of the optical device.

14. The mounting device of claim 13, further comprising:

a locking lever for securing said mounting shoe of the optical device in said mounting shoe receiver on said optical device mounting member.

15. The mounting device of claim 1, further comprising:

a removable power harness coupling said optical device mounting member to a rear bracket of said mounting assembly.

16. The mounting device of claim 15, wherein said removable power harness is a modular, replaceable assembly.

17. The mounting device of claim 15, wherein said power harness comprises:

a first interface coupled to said optical device mounting member;

a connection interface coupled to said first interface and to said pivoting assembly;

a second interface coupled to a rear bracket of said mounting assembly;

a first cable coupling said first interface to said connection interface; and a second cable coupling said connection interface to said second interface.

18. The mounting device of claim 1, wherein the optical device is selected from a night vision goggle device, an electronic night vision goggle device, a night vision binocular device, and a night vision monocular device.

19. A mounting device for mounting an optical device on a helmet, said mounting device comprising:

a mounting assembly removably attachable to the helmet;

a pivoting assembly having a first end pivotally attached to said mounting assembly and a second end opposite the first end;

a fore and aft adjustment assembly attached to said second end of said pivoting assembly;

a left and right adjustment assembly rotatably attached to said fore and aft adjustment assembly, wherein said left and right adjustment assembly is selectively rotatable at least 180 degrees relative to the fore and aft adjustment assembly about a first generally vertical axis;

an optical device mounting member rotatably attached to said left and right adjustment assembly, said optical device mounting member removably attachable to the optical device, wherein said optical device mounting member is (a) selectively movable in a generally horizontal transverse direction relative to a user's line of sight and (b) selectively rotatable at least 180 degrees relative to the left and right adjustment assembly about a second generally vertical axis;

said pivoting assembly rotatable between a first, operational position before the eyes of a user donning the helmet and a second, stowed position above a line of sight of a viewer donning the helmet;

a hinge pin defining a pivot axis and hingedly attaching said mounting assembly to said pivoting assembly, said hinge pin having one or more resilient protrusions;

said pivoting assembly including a pivot sleeve rotatably received about said hinge pin, said pivot sleeve rotatably defining a channel having a first groove extending parallel to the pivot axis and a second groove extending parallel to the pivot axis;

said one or more resilient protrusions removably received within said first groove when the pivoting assembly is moved to the first, operational position;

said one or more resilient protrusions removably received within said second groove when the pivoting assembly is moved to the second, stowed position;

one or more bores extending transversely relative to the pivot axis;

for each of said one or more bores, one or more spring washers received therein, said one or more spring washers compressible upon application of a predetermined force; and for each of said one or more bores, a plug disposed therein between said one or more spring washers and said pivot sleeve.

20. A mounting device for mounting an optical device on a helmet, said mounting device comprising:

a mounting assembly removably attachable to the helmet;

a pivoting assembly having a first end pivotally attached to said mounting assembly and a second end opposite the first end;

a fore and aft adjustment assembly attached to said second end of said pivoting assembly;

a left and right adjustment assembly rotatably attached to said fore and aft adjustment assembly, wherein said left and right adjustment assembly is selectively rotatable at least 180 degrees relative to the fore and aft adjustment assembly about a first generally vertical axis;

an optical device mounting member rotatably attached to said left and right adjustment assembly, said optical device mounting member removably attachable to the optical device, wherein said optical device mounting member is (a) selectively movable in a generally horizontal transverse direction relative to a user's line of sight and (b) selectively rotatable at least 180 degrees relative to the left and right adjustment assembly about a second generally vertical axis;

a locking mechanism for securing said mounting device in an operational position and, when said locking mechanism is unlocked, for moving said mounting device to a stowed position;

said locking mechanism having a base comprising an end plate, a first arm, a second arm, and a cavity between said first arm and said second arm and having two channels, one in each of said first and second arms; and one or more protrusions on a distal end of said base, said one or protrusions received within a channel in the pivoting member, the channel having an axial portion and a transverse portion, said one or more protrusions being confined to the axial portion when the pivoting member is in an operational position, said one or more protrusions received within the transverse portion when the pivoting member is moved to a stowed position.

21. A mounting device for mounting an optical device on a helmet, said mounting device comprising:

a mounting assembly removably attachable to the helmet;

a pivoting assembly having a first end pivotally attached to said mounting assembly and a second end opposite the first end;

a fore and aft adjustment assembly attached to said second end of said pivoting assembly;

a left and right adjustment assembly attached to said fore and aft adjustment assembly, said left and right adjustment assembly;

an optical device mounting member attached to said left and right adjustment assembly, said optical device mounting member removably attachable to the optical device;

said pivoting assembly rotatable between an operational position configured to position an attached optical device before an eye of a user donning the helmet and a stowed position configured to position an attached optical device above a line of sight of the user;

a hinge pin defining a pivot axis and hingedly attaching said mounting assembly to said pivoting assembly, said hinge pin having one or more resilient protrusions;

said pivoting assembly including a pivot sleeve rotatably received about said hinge pin, said pivot sleeve rotatably defining a channel having a first groove extending parallel to the pivot axis and a second groove extending parallel to the pivot axis;

said one or more resilient protrusions removably received within said first groove when the pivoting assembly is moved to the first, operational position;

said one or more resilient protrusions removably received within said second groove when the pivoting assembly is moved to the second, stowed position;

one or more bores extending transversely relative to the pivot axis;

for each of said one or more bores, one or more spring washers received therein, said one or more spring washers compressible upon application of a predetermined force; and for each of said one or more bores, a plug disposed therein between said one or more spring washers and said pivot sleeve.

22. The mounting device of claim 21, wherein the fore and aft adjustment assembly is rotatable between a first position and a second position, wherein an attached optical device is moved into closer proximity to the helmet when the fore and aft adjustment assembly is rotated between the first position and the second position when the pivoting assembly is in the stowed position.

* * * * *